US005809746A

United States Patent [19]

DePuy

[11] Patent Number: 5,809,746

[45] Date of Patent: Sep. 22, 1998

[54] OVERHEAD FLIGHT CONVEYOR ASSEMBLY FOR ERECTING FOUR-SIDED TAPERED PAPERBOARD CARTONS

[75] Inventor: Garth DePuy, Acworth, Ga.

[73] Assignee: Riverwood International Corporation, Atlanta, Ga.

[21] Appl. No.: 862,938

[22] Filed: May 27, 1997

[51] Int. Cl.[6] ..... B65B 43/26; B65B 43/32; B65B 27/04

[52] U.S. Cl. ..... 53/458; 53/48.7; 53/48.8; 53/566; 198/728; 198/734

[58] Field of Search ..... 53/48.7, 48.8, 53/48.9, 566, 251, 249, 381.1, 458, 398; 198/473.1, 727, 728, 734

[56] References Cited

U.S. PATENT DOCUMENTS

| | | | |
|---|---|---|---|
| 3,993,188 | 11/1976 | Müller | 198/461 |
| 4,012,887 | 3/1977 | Calvert et al. | 53/566 |
| 4,083,163 | 4/1978 | Ganz | 53/48.7 |
| 4,749,079 | 6/1988 | Minto | 198/742 |
| 5,042,636 | 8/1991 | Underwood | 198/372 |
| 5,501,318 | 3/1996 | Disrud | 198/732 |
| 5,546,734 | 8/1996 | Moncrief et al. | 53/534 |

*Primary Examiner*—Horace M. Culver

[57] ABSTRACT

An overhead flight conveyor assembly for use with a continuous motion packaging machine to erect four-sided tapered paperboard cartons is disclosed. The packaging machine has an elongate carton transport conveyor supported on a framework of the packaging machine, and moving along a path of travel. The overhead flight conveyor assembly has a housing supported on the framework of the packaging machine spaced above, and in alignment with the carton transport conveyor. A trailing lug assembly is supported on the housing and extends at least partially along the length thereof, the trailing lug assembly having at least one elongate conveyor chain with a series of spaced trailing lugs affixed thereto and being moved in the direction of the path of travel in timed relationship with the carton transport conveyor. A leading lug assembly is also supported on the housing and extends at least partially along the length of the trailing lug assembly, the leading lug assembly having at least one elongate conveyor chain with a series of spaced leading lugs affixed thereto and being moved in the direction of the path of travel in timed relationship with the movement of the trailing lugs. At least one trailing lug is moved into engagement with a rear side panel of the carton as it moves along the path of travel, while a leading lug is spaced above a top panel of the carton and moved along the path of travel, and is then moved toward and into engagement with a front side panel of the carton and a false score line defined therein to complete erection of the carton into a tapered configuration as the carton continuously moves along the path of travel.

24 Claims, 10 Drawing Sheets

OVERHEAD FLIGHT CONVEYOR ASSEMBLY FOR ERECTING FOUR-SIDED TAPERED PAPERBOARD CARTONS

FIELD OF THE INVENTION

This invention relates in general to packaging machines. More particularly, this invention relates to an overhead flight conveyor assembly including a leading lug assembly having a spaced series of leading lugs and a trailing lug assembly having a spaced series of trailing lugs, respectively, moved along separate endless conveyor chains on a housing supported above the packaging machine, for erecting four-sided tapered paperboard cartons being carried along a path of travel on a carton transport conveyor.

BACKGROUND OF THE INVENTION

The use of continuous motion packaging machines is well known in the art. Although these packaging machines come in many types of designs and configurations for use with a wide variety of articles, the invention here is concerned with packaging machines of the type that package articles within fully enclosed paperboard cartons. In packaging machines of this type, an unordered series of articles, for example beverage containers, is typically moved along an infeed conveyor to an article selector device which aligns the articles into an ordered series, and then forms the articles into groups of a pre-determined size for being packaged within the paperboard cartons. Simultaneous with the formation of the groups of articles, the packaging machine will sequentially withdraw substantially flat paperboard cartons from a carton supply magazine, will at least partially erect the cartons, and then place the cartons onto a carton transport conveyor constructed and arranged to move the at least partially erected cartons along a path of travel from an infeed end toward a discharge end of the packaging machine, at which point the packaged articles are discharged for further processing, and/or shipment.

Carton transport conveyors used on this type of packaging machine typically include spaced pairs of lugs extending along the length of the carton transport conveyor for forming spaced pockets, or flights, therebetween sized to receive a respective one of the at least partially erected paperboard cartons therein. The carton transport conveyor will move the cartons in timed relationship, i.e. in synchronization, with the movement of the articles through the article selector device so that as the articles are formed into the predetermined group size, they are then transferred into the paperboard carton, whereupon the carton will be closed about the articles. Paperboard cartons of this type are typically referred to as a sleeve-type cartons, and the packaging machines with which these cartons are used are typically referred to as fully enclosed packaging machines. An example of such a packaging machine is the QUICK-FLEX family of packaging machines manufactured by Riverwood International Incorporated of Atlanta, Ga.

One problem that has typically arisen with the use of partially erected, or completely erected, empty sleeve-type paperboard cartons occurs as they are carried along the path of travel on the carton transport conveyor toward the article selector device so that the articles have not yet been placed in the paperboard cartons. The tendency of the paperboard cartons, especially in conjunction with the high operating speed of current packaging machines, is that the top panels of the paperboard cartons will oftentimes lag behind their respective bottom panels so that the cartons move out of square within the flights of the carton transport conveyor which can lead to problems in transferring articles from the selector device into the cartons, such problems typically encompassing the tearing or destruction of the carton, as well as the jamming of the selector device, thus necessitating machine shut-down with the resultant loss in packaging efficiency and increase in packaging costs which occurs therewith.

One solution to this problem is disclosed in the Overhead Pusher Lug Assembly for Packaging Machines disclosed in U.S. Pat. No. 5,501,318 issued to Disrud and assigned to Riverwood International Corporation, in which an elongate overhead pusher lug assembly is positioned in alignment with, and spaced above the carton transport conveyor, and has a spaced series of lugs carried on an endless chain and moved in the direction of the path of travel for engaging a rear side wall of the carton, the lug being moved in timed relationship with the lugs of the carton transport conveyor so that the carton is maintained in "square" as it is moved along the carton transport conveyor toward the article selector device.

Although "squared" paperboard cartons of the type described above have been used for quite some time for packaging articles, some bottlers have begun to use tapered four-sided paperboard cartons in which the front and rear side panels, as well as the end panels formed by the side, bottom, and top end flaps, respectively, extend toward each other from the bottom panel toward the top panel of the carton for forming a four-sided tapered configuration, which type of carton is typically associated with long-neck beverage containers, for example long-neck beer bottles and the like. In order to utilize currently existing packaging machinery, thus avoiding the manufacture of packaging machines specifically for the use of tapered paperboard cartons, the tapered paperboard cartons will be provided with a false score line formed in at least one of the panels of the carton so that it can be made to lie flat in the carton supply magazine, whereupon the substantially flat and unerected paperboard carton is withdrawn from the supply magazine by a paperboard selector device, for example a segment wheel feeder or other known type of carton feed device, and passed toward the carton transport conveyor of the packaging machine. Thereafter, the paperboard carton may be moved along a series of stationary guides, also known as plows, which will begin to fold the bottom end flaps of the carton downwardly and to begin erection of the carton by moving the top panel upward and away from the bottom panel as the side panels hingedly connected thereto begin to open to form the sleeve-type configuration of the carton. The initial erection of the carton is typically done by moving the paperboard carton in the direction of the path of travel with the carton feeder-erection device whereupon the carton is moved against a leading lug of the carton transport conveyor so that a trailing lug overtakes the carton and at least partially erects the carton within the pocket or flight of the carton transport conveyor, whereupon the empty and now erected carton moves along the path of travel toward the article selector device.

This type of carton feed-erection device has proven satisfactory with some types of four-sided tapered paperboard cartons, for example the "six-score" paperboard cartons having a pair of spaced and parallel false scores formed, for example, in the opposed front and rear side panels of the carton so that the carton can be opened such that the top panel is parallel to the bottom panel, while the side panels are tapered upwardly and inwardly with respect to one another and extend toward the top panel. There is one type of four-sided tapered paperboard carton, however, for which the currently known overhead flight or pusher lug assemblies are not well suited. In particular, if a four-sided tapered paperboard carton is used which does not use the "six-score" method of constructing the carton, the known carton transport conveyors and overhead flight assemblies may not complete erection of the carton prior to its being moved to the article selector device.

In this type of tapered four-sided paperboard carton, for example, the carton will have a bottom panel and a spaced top panel, with front and rear side panels hingedly connected to the bottom and top panels, respectively. In known fashion, a bottom end flap and a spaced top end flap will be hingedly connected to the bottom and top panels of the carton, at each end thereof, and side flaps will be hingedly connected to the end edges of the front and rear side panels. However, this type of paperboard carton has only a single false score line formed, typically, in the front side panel spaced from and parallel to the hinged connection of the front side panel to the top panel. This type of construction allows the paperboard carton to be stacked flat in the carton supply magazine, and to be at least partially erected using currently available packaging machines. However, once placed into the pockets of a carton transport conveyor in its partially erected state, when and if the rear side panel is engaged by an overhead pusher lug assembly, for example, the false score line defined in the front panel will not be unfolded and erection of the carton into its tapered configuration will not be completed, thus leading to the aforementioned problems in the downstream transfer of the articles into the paperboard carton.

Accordingly, a need exists for an improved overhead flight assembly adapted for use in completing the erection of four-sided tapered paperboard cartons of the type having a false score line defined in the front side panel of the carton spaced from, and parallel to the top panel thereof. Moreover, a need for such an improved overhead flight assembly exists which allows for flexibility in handling this type of four-sided tapered paperboard carton so that it is adapted for use with various article groupings, to include, for example, six-packs, eight-packs, nine-packs, twelve-packs, fifteen-packs, eighteen-packs, and twenty-four-packs, also known as cases. The need also exists for the ability to retrofit such an improved overhead flight assembly to existing packaging machines to minimize the cost of configuring packaging machines to handle this type of paperboard carton, and to allow for increased rates of packaging productivity with the use thereof.

SUMMARY OF THE INVENTION

The present invention provides an improved overhead flight conveyor assembly for use in erecting four-sided tapered paperboard cartons on continuous motion packaging machines which overcomes some of the design deficiencies of other overhead flight or pusher lug assemblies known in the art. The improved overhead flight conveyor assembly of this invention provides a simple, efficient, and highly flexible device for completing the erection of four-sided tapered paperboard cartons as they are carried in the flights of a carton transport conveyor along a path of travel toward an article selector device of the packaging machine. The improved overhead flight conveyor assembly of this invention thus minimizes the likelihood of the paperboard carton becoming damaged or destroyed when articles are transferred from the article selector device into the paperboard carton, and also serves to prevent the articles from becoming jammed in the selector device due to their failure to feed into an unerected carton, necessitating a halt in packaging operations. In turn, this allows for increased reliability, and thus speed, in packaging operations. The relative simplicity and ease of use of this improved overhead flight conveyor assembly in comparison with the known overhead flight or pusher lug assemblies allows for a higher degree of flexibility and reliability in use for erecting four-sided tapered paperboard cartons. The construction of the overhead flight conveyor assembly of this invention is readily adapted for use with most any type of paperboard carton, to include square four-sided cartons, as well as tapered four-sided cartons.

This invention attains this high degree of flexibility while maintaining simplicity in design, construction, and operation by providing an improved overhead flight conveyor assembly for use with a packaging machine in which the flight conveyor assembly has a housing supported on the framework of the packaging machine space above, and in alignment with, an elongate carton transport conveyor moving in the direction of the path of travel from an infeed end toward a discharge end of the packaging machine. A trailing lug assembly is supported on the housing and extends at least partially along the length of the housing in the direction of the path of travel. The trailing lug assembly has at least one endless first conveyor chain with a first series of spaced trailing lugs affixed thereto and moved in the direction of the path of travel in timed relationship with the movement of the carton transport conveyor on which at least partially erected four-sided tapered paperboard cartons are positioned and being moved in the direction of the path of travel. A leading lug assembly is also supported on the housing, and extends at least partially along the length of the trailing lug assembly. The leading lug assembly has at least one second endless conveyor chain with a first series of spaced leading lugs affixed thereto and being moved in the direction of the path of travel in timed relationship with the movement of the trailing lugs of the trailing lug assembly. A trailing lug is moved into engagement with a rear side wall of a four-sided tapered paperboard carton as the carton moves along the path of travel on the carton transport conveyor, whereupon a leading lug is held spaced above and moved over the top panel of the carton as the carton advances along the path of travel, and is moved toward and into engagement with the front side panel of the carton, and the false score line defined therein, so that the leading lug unfolds the false score line to complete erection of the carton into its tapered configuration upstream of the placement of articles into the carton from an article selector device.

In a first embodiment, the leading lug assembly of the improved overhead flight conveyor assembly of this invention has at least one elongate cam track extending from a first end of the housing toward a second end of the housing in the direction of the path of travel and extending the length of the leading lug assembly. The cam track is supported on the housing with respect to the at least one second conveyor chain of the leading lug assembly. The leading lugs of the leading lug assembly each have a proximal end and a spaced distal end, the proximal end of each lug being affixed to a lug carrier which is pivotally affixed to the at least one second conveyor chain, the lug carrier having a cam follower for being guided within the cam track, the cam track defining a pre-determined cam profile so that the leading lug is inclined in the direction of the path of travel as it is moved over the top panel of the partially erected carton, whereupon the distal end of the inclined lug is then moved along an arcuate line toward and into engagement with the front side panel and false score line defined therein, and then moved toward the trailing lug where it is moved into its final position and locks the four-sided tapered paperboard carton into its erected and tapered configuration for receiving articles therein.

In a second embodiment, the leading lug assembly of the overhead flight conveyor assembly moves the leading lugs from the first end of the housing and in the direction of the path of travel along a ramped incline extending away from the housing and toward the carton transport conveyor and the partially erected carton carried thereon, the leading lug having a profiled rear surface constructed and arranged to unfold the false score line in the front side panel of the carton as the inclined surface of the leading lug assembly progressively moves the leading lug toward, and into engagement with the front side panel and false score line of the carton, to once again complete erection of the carton as it is moved along the path of travel on the carton transport conveyor.

The improved overhead flight conveyor assembly of this invention thus allows for a novel method of erecting four-sided tapered paperboard cartons on packaging machines, which includes the steps of moving a partially erected carton on the carton transport conveyor in the direction of the path of travel, moving a trailing lug provided as a part of the trailing lug assembly in the direction of the path of travel in timed relationship with the movement of the carton transport conveyor and into engagement with the rear side panel of the carton as it advances along the path of travel, moving a leading lug provided as a part of the leading lug assembly in the direction of the path of travel spaced above the top panel of the carton, and then moving the leading lug toward and into engagement with the front side panel of the carton and the false score line defined therein, unfolding the false score line in the front panel in response thereto, and completing erection of the carton into its tapered configuration as it continues to move along the path of travel on the carton transport conveyor.

This method can be accomplished by either pivotally inclining the leading lug in the direction of the path of travel so that the lug moves along the path of travel spaced above the top panel of the carton whereupon a distal end of the lug is then moved downward along an arcuate path into engagement with the front panel of the carton; or by moving the leading lug along a ramped incline with respect to the leading lug assembly and the partially erected carton, and progressively moving the leading lug into engagement with the front panel and false score line defined therein, while also using a profiled rear surface of the leading lug engaged with the front panel of the carton to complete erection of the carton into its tapered configuration as it is moved along the path of travel on the carton transport conveyor.

The unique and novel structure, and method of using, this invention, thus provides a simple, yet highly efficient method and device for ensuring that four-sided tapered paperboard cartons are completely erected within the flights or pockets of a carton transport conveyor prior to being moved toward and adjacent an article selector device so that the pre-formed groups of articles can be quickly and easily transferred into the erected paperboard carton to maintain the high rates of packaging efficiency currently available with the known packaging machines. Moreover, due to the unique construction of this invention, the overhead flight conveyor assembly may be retrofit to existing packaging machines, and can be used with both tapered and squared paperboard carton configurations. This invention thus allows for a greater degree of flexibility in packaging operations, greater ease of maintenance, and greater ease of use than heretofore known in the art. Additionally, the improved overhead flight conveyor assembly of this invention is less likely to damage the paperboard cartons during handling prior to, and after transfer of articles from the article selector device into the cartons, which is thus less likely to result in jamming of the article selector device, or destruction of the paperboard cartons.

Accordingly, the objects of the present invention include the provision of an improved overhead flight conveyor assembly for use in erecting four-sided tapered paperboard cartons and which can also be used with square paperboard cartons, and which is constructed and arranged to be easily changed over from one product group sizing, and paperboard carton size, to another. The present invention accomplishes this object, among others, while providing for flexible, efficient, and continuous high speed article packaging operations.

DETAILED DESCRIPTION OF THE PREFERRED EMBODIMENTS

Figure 1:
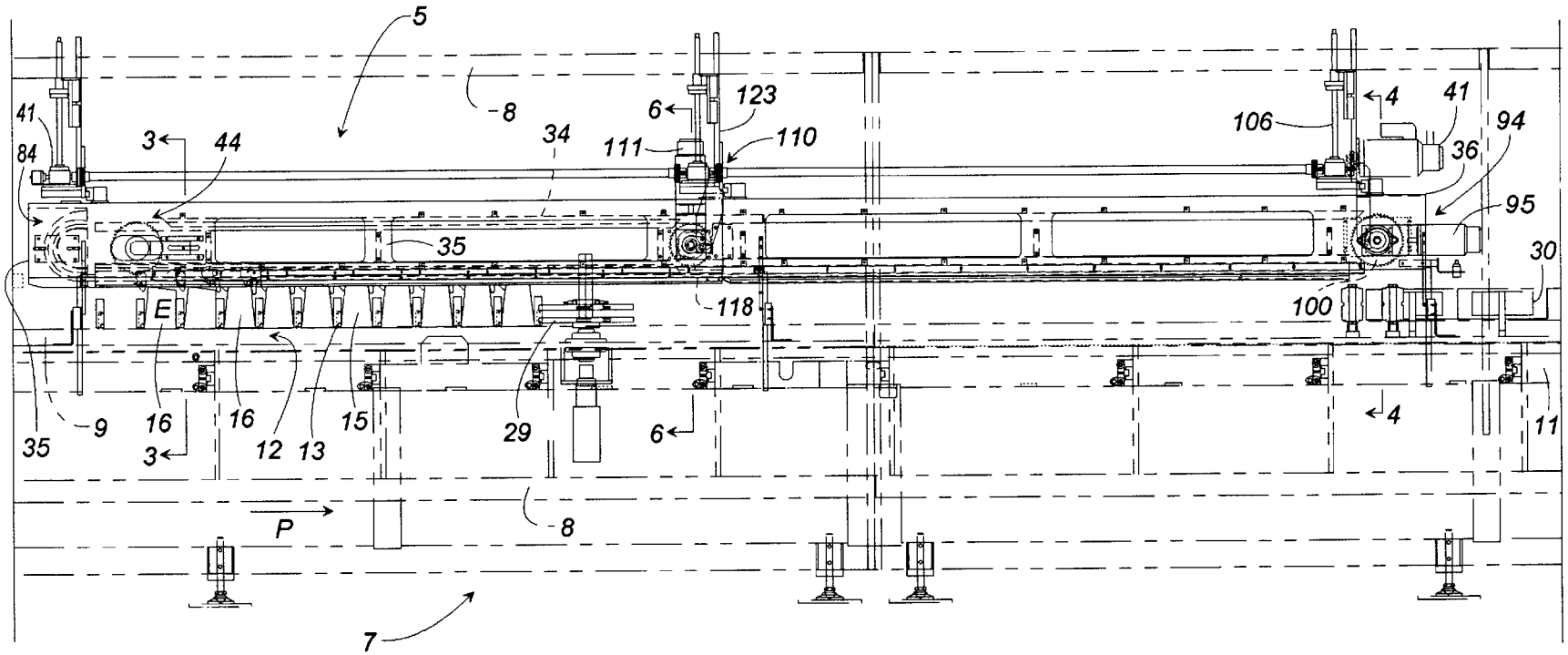
FIG. 1 illustrates a side elevational view of a first embodiment of the improved overhead flight conveyor assembly of this invention.

Referring now in detail to the drawings, in which like reference characters indicate like parts throughout the several views, a first preferred embodiment of the overhead flight conveyor assembly 5 of this invention is illustrated in FIGS. 1–6. Referring first to FIG. 1, a continuous motion packaging machine 7 is shown extending along a path of travel designated by the reference character "P". The path of travel is equivalent to a processing path along which the articles (not illustrated) to be packaged are moved during the course of being packaged within a separate one of a series of cartons 16 being moved along the path of travel. Packaging machine 7 has an elongate framework 8 constructed in known fashion, with an infeed end 9, and a spaced discharge end 11. Although not shown in detail, it is understood by those of skill in the art that a carton supply magazine having a supply of substantially flat and unopened carton blanks received therein will be positioned upstream of the infeed end 9 of the packaging machine, with a carton feeder-erection device (not illustrated) positioned intermediate the carton magazine and the infeed end of the packaging machine, so that each of cartons 16 are at least partially erected while being placed on a carton transport conveyor 12 extending along and being moved in the direction of the path of travel by conventional drive means, to include a servo-motor drive, or a drive geared to the main drive of the packaging machine, for example.

Carton transport conveyor 12 has a spaced series of lugs 13 attached to at least one pair of spaced, parallel endless conveyor drive chains (not illustrated) formed as a part of the carton transport conveyor, and used to move the lugs downstream along the path of travel. Lugs 13 form a series of spaced pockets 15, also known as flights, therebetween for holding respective ones of cartons 16 therein. Cartons 16 as shown in FIGS. 1, 2, 4, 6, and 7, are four-sided paperboard cartons known to those in the industry as a sleeve-type carton having a pair of spaced open ends, through at least one end of which the articles are transferred for being packaged within the carton.

Figure 7:
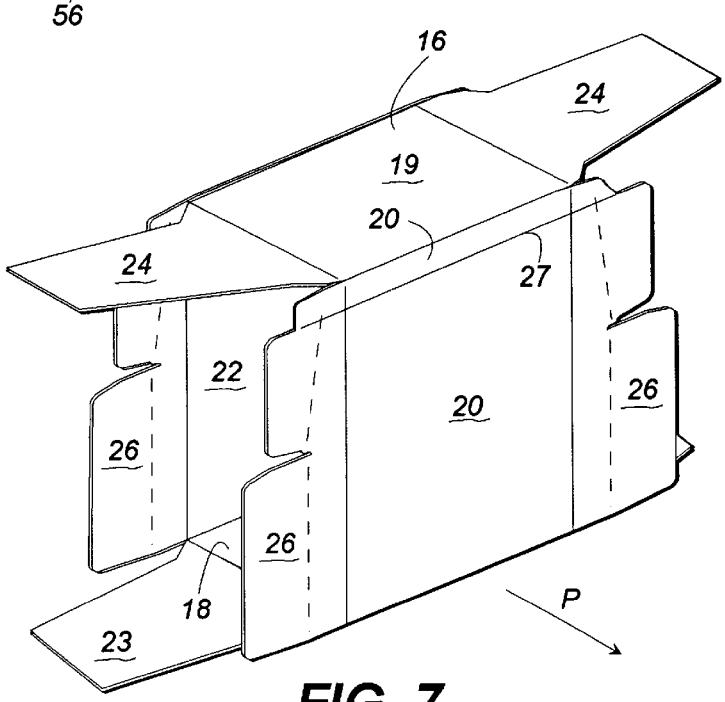
FIG. 7 is a front and top perspective view of a partially erected four-sided tapered paperboard carton having a false score defined in the front panel thereof.

Carton 16 is illustrated in greater detail in FIG. 7, in which the carton is shown having a bottom panel 18 with a spaced top panel 19. A front side panel 20, and a spaced and opposed rear side panel 22, each of which is hingedly connected to the bottom panel and top panel, respectively, along folded score lines for forming the four-sided paperboard carton in which the articles will be packaged. When fully erected, top panel 19 will be parallel to bottom panel 18. Still referring to FIG. 7, the carton is provided with a pair of bottom end flaps 23 hingedly connected to the opposed ends of bottom panel 18, with a pair of spaced top end flaps 24 hingedly connected to the opposed ends of top panel 19. Side flaps 26 are formed along the side edges of front side panel 20 and rear side panel 22. The bottom and top end flaps are known to those of skill in the art as the major flaps, whereas the side flaps 26 are known as the minor flaps. The minor flaps will be folded inwardly toward the open ends of the carton, whereupon the bottom end flap and top end flap, respectively, will be folded toward one another, glue will be applied to the end flaps, whereupon the top end flap will be moved against the bottom end flap so that the open ends of the paperboard carton will be closed thus creating a fully enclosed four-sided paperboard carton.

Figure 2:
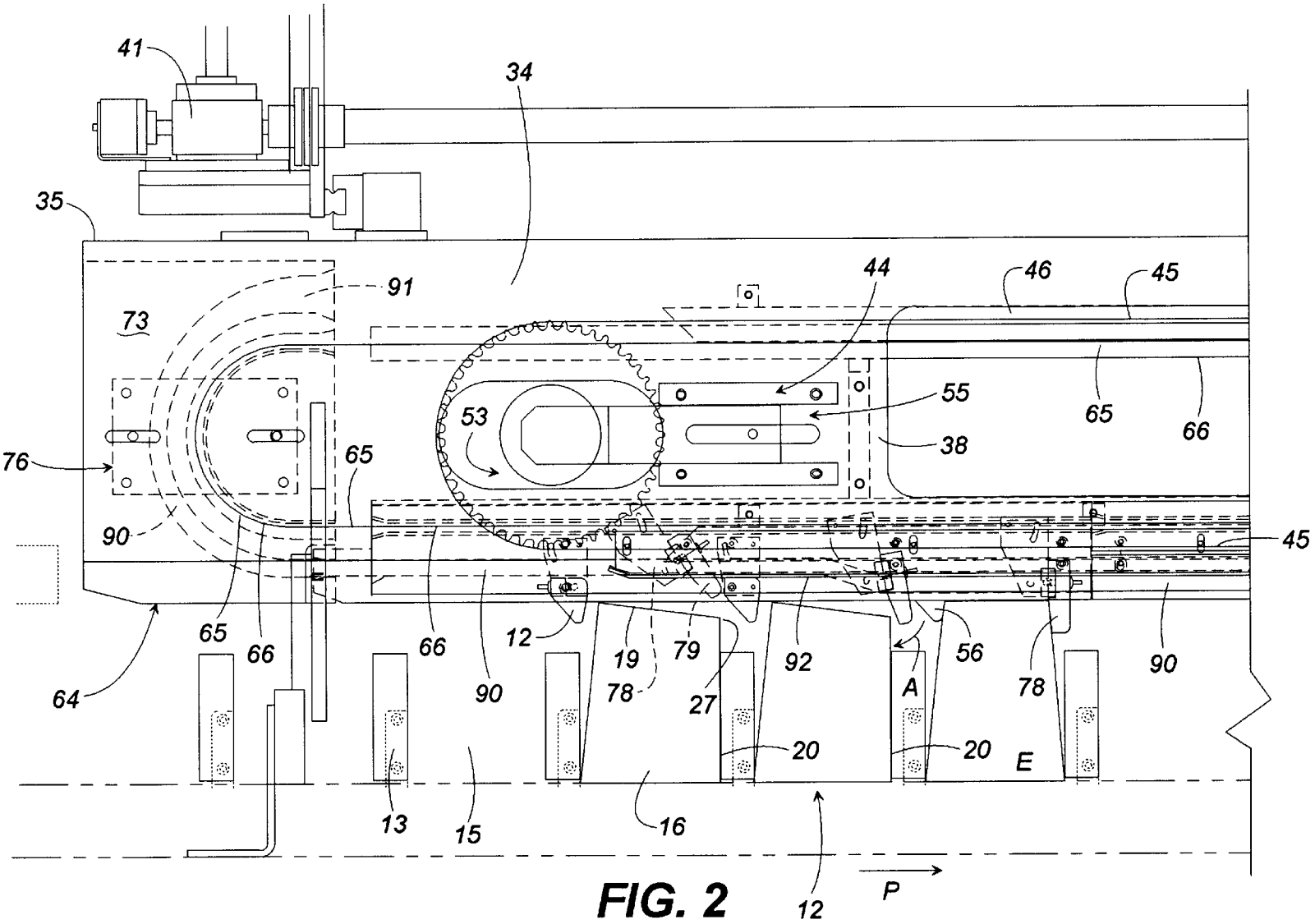
FIG. 2 is an enlarged and partially cut away partial side elevational view of the tension end of the leading lug and trailing lug assemblies of the overhead flight conveyor assembly of FIG. 1.

Paperboard carton 16 of FIG. 7 is not a four-sided "square" paperboard carton, rather it is a tapered carton in which the front side panel 20, rear side panel 22, and the ends of the carton formed by bottom end flaps 23, top end flaps 24, in conjunction with side flaps 26, are tapered toward the top panel 19 from bottom panel 18, each of the respective panels and/or flaps, extending inwardly toward each other as they are moved toward the top panel, illustrated generally in FIGS. 1 and 2. In order to place cartons 16 within a conventional carton magazine it is necessary that the cartons lie substantially flat prior to erection. In order to accomplish this, however, in a tapered carton of the type shown in FIG. 7, a false score line 27 is defined in front side panel 20, extending from the two side edges thereof laterally across the front side panel, being parallel to and spaced from the hinged connection of front side panel 20 to top panel 19. Carton 16 is shown in its erected, tapered configuration in FIGS. 1 and 2, designated by the reference numeral "E", said erection taking place after the carton has been moved on the carton transport conveyor along the path of travel in conjunction with the use of overhead flight conveyor assembly 5, as described in greater detail below.

Although carton 16 is shown as having only a single false score 27 defined in the front side panel of the carton, it is anticipated that a "six-score" tapered paperboard carton (not illustrated) can also be erected using the overhead flight conveyor assembly 5 of this invention. A six-score tapered paperboard carton would have a pair of false score lines defined in the front and opposed rear side panels of the carton, so that as the carton is being moved from the carton supply magazine into the carton erection device, and into the pockets 15 of carton transport conveyor 12, the six-score carton will be at least partially erected by the movement of the carton against a leading one of lugs 13 as the trailing one of lugs 13 comes up and forces the top panel of the carton away from the bottom panel, moving the side walls into their tapered configuration. It is also anticipated, although not illustrated in the Figures, that overhead flight conveyor assembly 5 could be used with conventional "square" four-sided paperboard cartons commonly used for packaging purposes.

Referring once again to FIG. 1, packaging machine 7 will include an end flap tuck-in wheel 29 positioned downstream of the article selector device (not illustrated) used to move groups of articles formed therewith into the paperboard cartons, the end flap tuck-in wheel being used to close the open side flaps 26 of the cartons prior to the bottom and top end flaps being folded toward one another, whereupon the carton will be passed to a glue application station (not illustrated), and from there to a compression section 30 which will compress the glued end flaps together for sealing the paperboard carton about the articles packaged therein. So constructed, packaging machine 7 is a continuous motion packaging machine of a type known to those skilled in the art as a fully enclosed packaging machine. An example of this type of machine is the QUIKFLEX family of packaging machines manufactured by Riverwood International Corporation of Atlanta, Ga. A QUICKFLEX-type fully enclosed packaging machine is described in greater detail in U.S. Pat. No. 5,546,734, issued to *Moncrief,* et al. on Aug. 20, 1996, and assigned to Riverwood International Corporation, which patent is incorporated by reference as is set forth fully herein.

Figure 3:
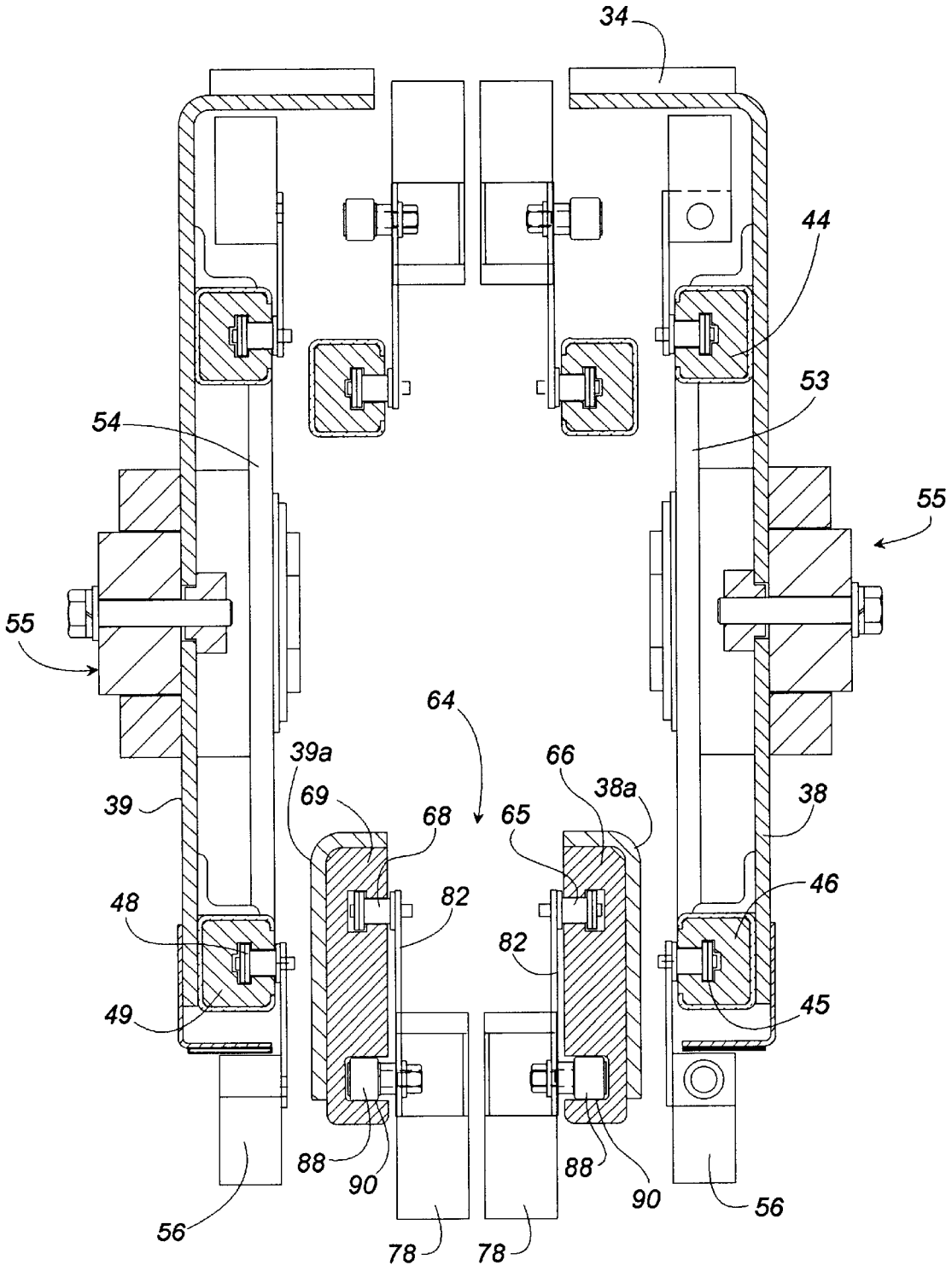
FIG. 3 is a partial cross-sectioned elevational view along line 3—3 of FIG. 1 illustrating the housing, leading, and trailing lug assemblies of the overhead flight conveyor system of FIG. 1.

As best shown in FIGS. 1 and 2–4, overhead flight conveyor assembly 5 includes an elongate housing 34 supported on the framework 8 of packaging machine 7, spaced above, and in alignment with carton transport conveyor 12 and extending along the path of travel. Housing 34 has a first or tension end 35 and a spaced second or drive end 36. Housing 34, as shown in FIG. 3, has a first elongate side panel 38 and a spaced, parallel second side panel 39, both of which extend the length of the housing. As shown in FIGS. 1, 2, 4, and 6, housing 34 may also be provided with a lift drive system 41 for raising and lowering the housing with respect to the carton transport conveyor. In addition, although not illustrated herein, it is anticipated that housing 34 may be constructed to vary in width by increasing or decreasing the distance between side panels 38 and 39 in accordance with any corresponding change in the width of the carton transport conveyor, based on the size of the article groups being packaged and the size of the cartons being filled with the article groups, although as shown in the drawings the side panels are fixed in spaced relationship with respect to one another. Lift drive system 41 is explained in greater detail in U.S. patent application Ser. No. 08/660,532, filed on Jun. 7, 1996, by *Malanowski,* and assigned to Riverwood International Corporation, which patent application is incorporated by reference as is set forth fully herein.

Figure 4:
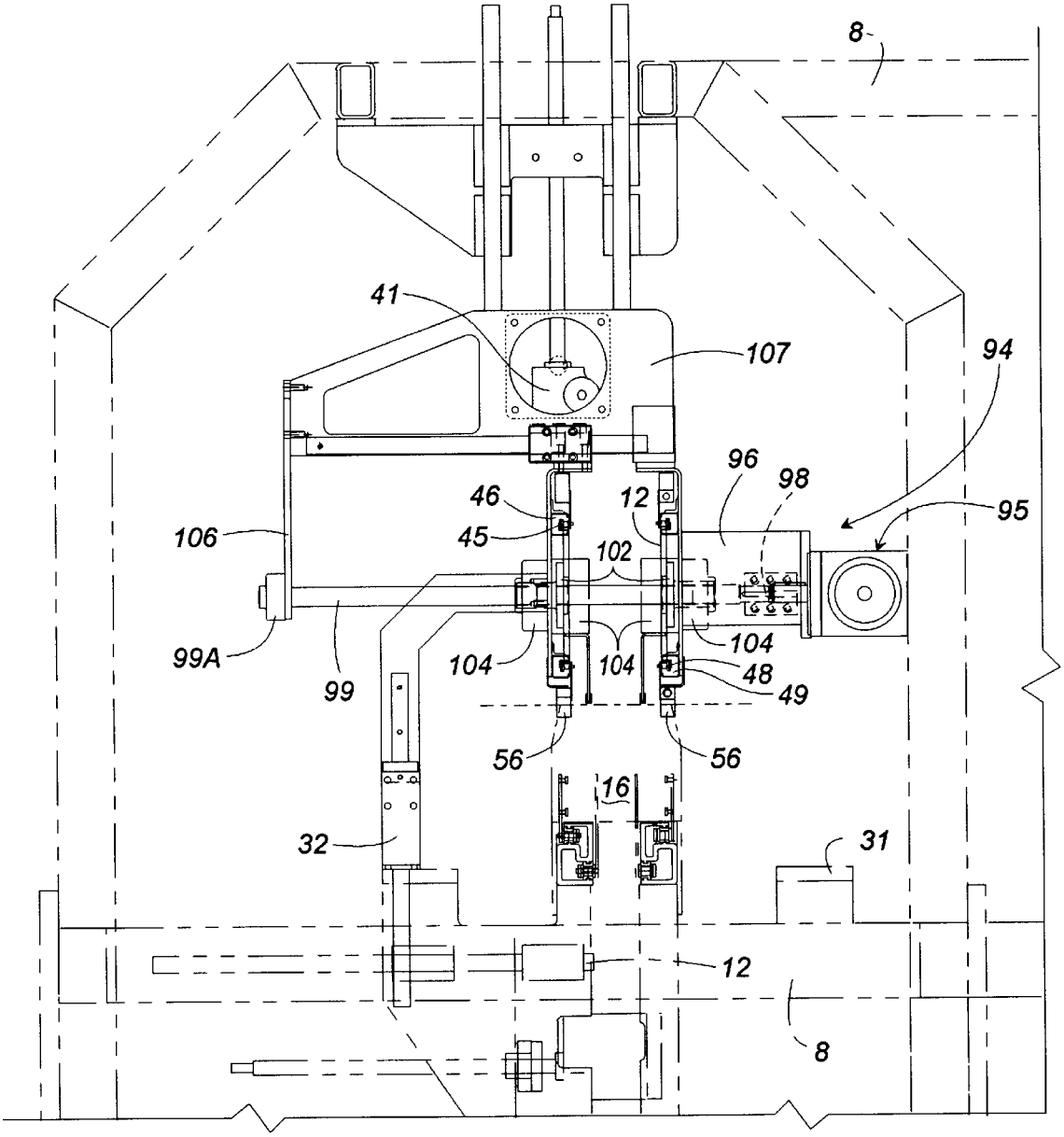
FIG. 4 is a partial cross-sectioned elevational view along line 4—4 of FIG. 1 illustrating the trailing lug assembly drive system.

In its first embodiment, the overhead flight conveyor assembly of this invention includes a trailing lug assembly 44 and a leading lug assembly 64, both of which are supported for movement in the direction of the path of travel on housing 34, these respective lug assemblies being positioned within the space defined by side panels 38 and 39. Referring now to FIGS. 2 and 3, trailing lug assembly 44 includes a first endless conveyor chain 45 extending within an elongate chain track 46 mounted to side panel 38 of the housing, and used to guide conveyor chain 45 along the length of housing 34. The trailing lug assembly also includes a second, spaced, parallel endless conveyor chain 48 (FIGS. 3, 4), held within a second elongate chain track 49 fastened to side panel 39 of the housing. As shown in FIG. 3, conveyor chains 45 and 48 are spaced from and parallel to one another and lie within a common plane along the path of travel. As shown in FIGS. 1 and 4, conveyor chains 45, 48 are entrained over a first drive sprocket 50, and a spaced, parallel second drive sprocket 52, respectively, for moving the conveyor chains together along the path of travel. At their opposite ends, each of the conveyor chains 45, 48 are passed over a first tension or idler sprocket 53 (FIG. 2) for conveyor chain 45, conveyor chain 48 being passed over an identical second tension or idler sprocket 54 (FIG. 2) spaced from and parallel to sprocket 53. Each of idler sprockets 53, 54 has a tensioning assembly 55 (FIG. 2) for drawing the conveyor chains 45, 48 taut, or for introducing any desired amount of slack in the chains.

Figure 5A:
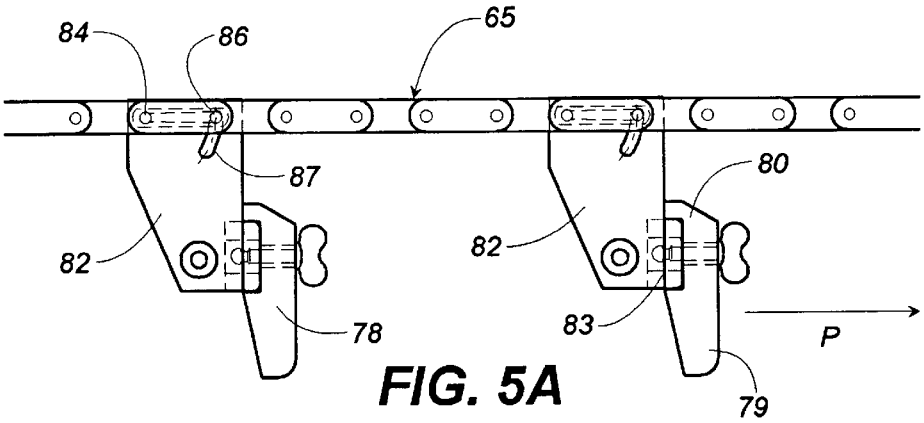
FIG. 5A is an enlarged partial elevational view of a leading lug assembly conveyor chain, and of the leading lugs pivotally affixed thereto of the overhead flight conveyor assembly of FIG. 1.
Figure 5B:
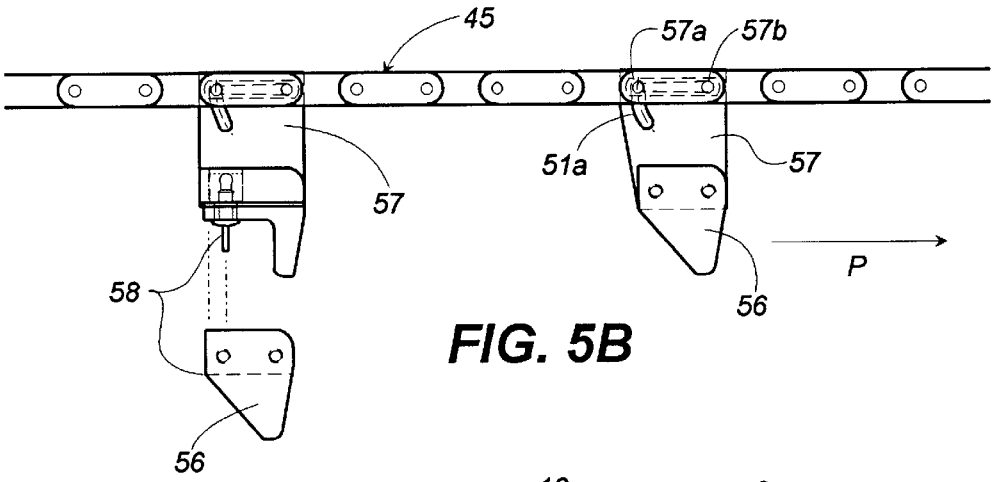
FIG. 5B is an enlarged partial elevational view of a trailing lug assembly conveyor chain, and of the trailing lugs affixed thereto of the overhead flight conveyor assembly of FIG. 1.

As best shown in FIGS. 2 and 3, trailing lug assembly 44 includes a spaced series of trailing lugs 56 attached to conveyor chains 45 and 48, respectively. Each of the trailing lugs 56 attached to these two chains are spaced from, and parallel to one another thus forming pairs of trailing lugs 56 which move together along the path of travel. Each trailing lug 56 is attached to a carrier 57, the carrier 57 in turn being fastened to the respective conveyor chains 45, 48. This is illustrated in greater detail in FIG. 5B. Moreover, and as shown in FIG. 5B, trailing lugs 56 may be attached to carriers 57 using a quick release fastener 58 constructed and arranged to allow for quickly and easily removing, replacing, and fastening respective ones of trailing lugs 56 to carriers 57. This allows for different constructions of trailing lugs 56 to be used, when, and if, desired. Also, it is shown in FIG. 5B that carriers 57 are provided with an arcuate slot 57*a* which allows for the carrier, and thus trailing lug 56, to pivot about pin 57*b* as pin 57*c* is guided within the arcuate slot during partial rotation of the carrier, and thus the trailing lug. This is provided for the purposes of raising, and/or lowering trailing lugs, as desired, and as described more generally in U.S. Pat. No. 5,501,318 to *Disrud,* issued Mar. 26, 1996, and assigned to Riverwood International Corporation, which patent is incorporated by reference as is set forth fully herein. Thus, and although it is anticipated that trailing lugs 56 may be "raised" and/or "lowered" with respect to one another along the length of the conveyor chains 45, 48, it is anticipated that trailing lugs 56 will be in their raised configuration as shown in FIGS. 1 and 2 for the purposes of engaging the rear side panels 22 of the respective cartons 16 being moved along the path of travel on carton transport conveyor 12.

Referring to FIGS. 1, 2, and 3, overhead flight conveyor assembly 5 of this embodiment also includes a leading lug assembly 64, having a first endless conveyor chain 65 held within an elongate chain track 66 fastened to a sub-panel 38*a* of side panel 38, and in turn being fastened to housing 34. In similar fashion, a second endless conveyor chain 68, spaced from, and parallel to first conveyor chain 65, is also entrained within an elongate chain track 69 fastened to a sub-panel 39*a* fastened to side panel 39, and formed as a part of housing 34. Each of chain tracks 46, 49, for trailing lug assembly 44, and chain tracks 66, 69, for leading lug assembly 64, are milled in blocks of an ultra-high molecular weight ("UHMW") plastic having the benefits of being rigid, durable, affordable, and being easy to machine. The plastic of the respective cam tracks, therefore, acts as a bearing surface upon which the chains are carried as they move in the direction of the path of travel from tension end 35 toward drive end 36 of the housing and back as the chains complete their endless and circuitous route about the respective drive and idler sprockets of the flight conveyor assembly.

Figure 6:
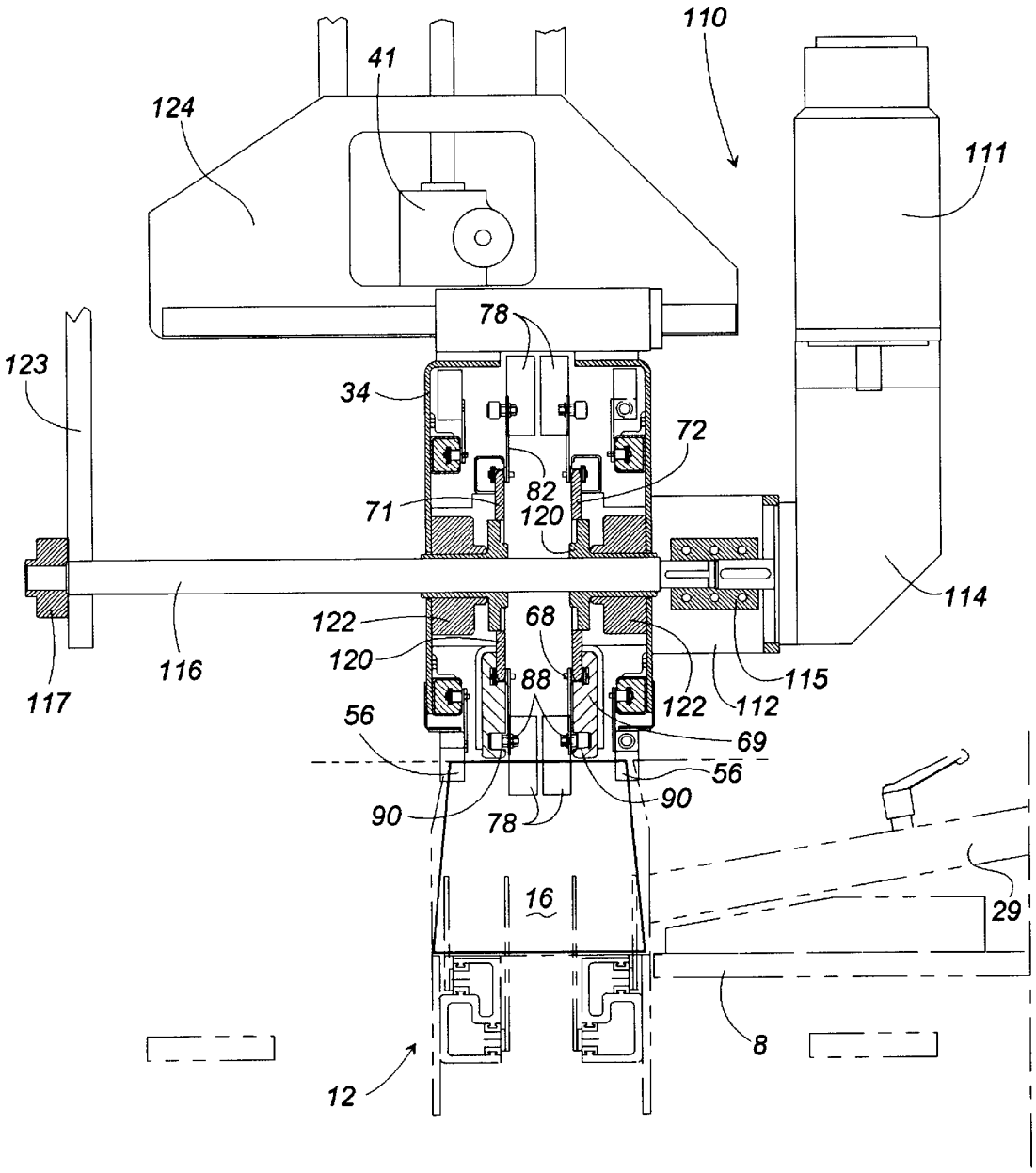
FIG. 6 is a partial cross-sectioned elevational view along line 6—6 of FIG. 1 illustrating the leading lug assembly drive system.

Referring to FIG. 6, first conveyor chain 65 of the leading lug assembly is entrained about a first drive sprocket 71, and second conveyor chain 68 is entrained about a second drive sprocket 72, the two drive sprockets being spaced from, and parallel to one another. Both of the drive sprockets are moved together in unison so that the conveyor chains are moved along the path of travel in circuitous fashion. However, and referring now to FIG. 2, leading lug assembly 64 does not use idler sprockets to support chains 65, 68 at the tension end 35 of housing 34, rather it uses what is known to those in the industry as a "tombstone", which is in actuality a tension-guide block made of UHMW plastic in which the chain tracks with the respective drive chains is defined. As shown in FIG. 2, a first tension-guide block 73 is illustrated for conveyor chain 65, a second spaced, parallel tension-guide block being provided for second chain 68, which is not shown in FIG. 2 for the purposes of clarity. In fashion similar to the idler sprocket 53 of the trailing lug assembly, the tension-guide block 73 of the leading lug assembly is provided with a tensioning assembly 76 for drawing conveyor chain 65 taut, or introducing any desired amount of slack therein.

Leading lug assembly 64 includes a spaced series of pairs of leading lugs 78 pivotally fastened to chains 65, 68, respectively, and extending the length of the conveyor chains as best shown in FIGS. 1, 2, 3, and 6. As shown in FIG. 5A, each leading lug 78 includes a distal end 79, and a spaced proximal end 80. The proximal end 80 of the leading lug is fastened to a carrier 82, which may be accomplished using a quick release fastener 83 as shown in FIG. 5A, although the leading lug could be permanently affixed to the carrier if so desired.

Carrier 82 is constructed to pivot on conveyor chains 65, 68, respectively, in the manner shown in FIG. 2. Accordingly, carrier 82 has a pivot pin 84 about which it pivots, and a spaced guide pin 86, the two pins being formed as a part of the links of the conveyor chains to which the carriers are pivotally fastened. An arcuate slot 87 is defined in carrier 82 in which guide pin 86 is received so that as the carrier rotates about pivot pin 84, the degree of rotation about pivot pin 84 is prescribed by arcuate slot 87 in conjunction with guide pin 86 received therein. Also, and for the purposes described in greater detail below, each carrier 82 includes a cam roller 88 extending away therefrom for being received within a cam track 90, best shown in FIGS. 2 and 3. Cam track 90 for each of chains 65, 68 extends the length of leading lug assembly 64, and is shown being defined in the same piece of UHMW plastic as is that portion of chain tracks 66, 69 in which conveyor chains 65, 68 are received as they are moved from the tension end toward the drive end of the housing, although a separate cam track may be provided if so desired. The cam track is not provided on the return leg of the conveyor chains from the drive sprockets 71, 72, toward the tension end of the housing as it is not necessary, and thus cost is reduced by providing cam track 90 only where needed. It is anticipated that cam roller 88 will comprise a needle bearing cam roller of a type known to those skilled in the art and may, for example, include those cam rollers manufactured by McGill.

Referring to FIG. 2, as no cam track is provided on the return leg of the conveyor chains from the drive end toward the tension end of the housing, a throat 91 is milled into the respective tension-guide blocks, again only a single guide block 73 for conveyor chain 65 being shown in FIG. 2, so that the respective cam rollers are guided into the cam track prior to proceeding in the direction of the path of travel. As shown in FIG. 2, a cam profile 92 is milled into the cam track intermediate the ends of the leading lug assembly, the cam profile being of a pre-determined configuration and being constructed and arranged to guide the distal ends of the respective leading lugs along an arcuate path of travel, denoted by the reference character "A" in FIG. 2 as the respective carriers 82 are pivoted about pivot pins 84 due to the action of cam rollers 88 passing along cam track 90, and along cam profile 92, for the purpose of erecting the cartons as described in greater detail below. Accordingly, cam profile 92 may be of any pre-determined configuration sufficient to move the leading lugs through the arcuate range of travel desired, all of which may be varied dependent upon the size of the cartons 16 being erected, the configuration of the leading lugs 78, and the range of motion needed to move the leading lugs toward and into engagement with the front side panel 20 and the false score line 27 defined therein for completing erection of the carton into its tapered configuration as shown by reference character "E" in FIG. 2.

The drive system 94 for trailing lug assembly 44 is illustrated in FIG. 4. The drive system includes a servomotor 95 supported on a servomotor mount 96, which in turn is then fastened to housing 34. A coupling 98 is provided for connecting servomotor 95 to an elongate spline shaft 99 having a bearing 99*a* at the end thereof spaced opposite the servomotor, and supported by a shaft support arm 106. Although not specifically illustrated herein, servomotor 95 will have a right angle gear drive operably engaged with the output shaft (not illustrated) of the servomotor at one end of the gear drive, the other end of the right angle gear drive being operably engaged with coupling 98. The drive sprockets 50, 52, for conveyor chains 45, 48, respectively, are mounted separately on spline shaft 99 on separate hubs 103. Each of hubs 103 are splined hubs, and are received on spline shaft 99 in known fashion and affixed thereto so that they rotate together with spline shaft 99 as it is driven by servomotor 95. Shaft 99 is provided with a pair of bearing assemblies 104 to support the shaft for rotation on the two side panels 38, 39 (FIG. 3) of housing 34. Bearing assemblies 104 will be conventional roller bearings of the type known to those skilled in the art. Also, and as shown in FIG. 4, an overhead lift support 107 is affixed to the top edges of side panels 38, 39 (FIG. 3) of housing 34, and is used in conjunction with lift drive system 41 for raising and lowering the overhead flight conveyor assembly with respect to carton transport conveyor 12 when, for example, it is necessary to raise the overhead flight conveyor assembly to remove a damaged or defective paperboard carton, or to remove any jam of the articles in the article selector (not illustrated) resulting from formation of the articles into groups of articles.

The drive system 110 for the leading lug assembly of the first embodiment of this invention is illustrated in FIG. 6. The drive system for the leading lug assembly has a servomotor 111 fastened to a right angle gear drive 114, both of which are supported on a servomotor assembly mount 112 fastened to housing 34. A coupling 115 is provided for fastening the right angle gear drive to an elongate spline shaft 116 having a bearing 117 at its end opposite the servomotor, and carried on a shaft support arm 123. As shown in FIG. 6, first drive sprocket 71 and second drive sprocket 72 are each mounted on shaft 116 by separate hubs 120. As with the trailing lug assembly drive system hubs 120 are splined hubs, so that the drive sprockets are separately affixed to shaft 116 and rotate together therewith. It is anticipated that hubs 103, 120 could be keyed to shafts 99, 116, respectively, or could otherwise be fastened to the shafts by threaded fasteners, or by other conventional fasteners. Shaft 116 is supported for rotation on housing 34 by a pair of spaced bearing assemblies 122, the bearing assemblies comprising roller bearings or other bearings suitable for supporting shaft 116 for rotation on housing 34. As shown in FIG. 6, an overhead lift support 124 is fastened to the top of housing 34, and used in conjunction with lift guide system 41 for raising and lowering the housing with respect to the carton transport conveyor 12, as desired.

As shown in FIGS. 2, 5A, and 5B, the respective trailing lugs 56, and leading lugs 78 alternate with respect to one another in series along the length of the respective conveyor chains 45, 48, and 65, 68, forming a series of pockets of a first pitch, or width, therebetween. It is anticipated that these will commonly be on twelve-inch centers with respect to one another. The phasing, or distance, between the leading and trailing lugs is adjusted by the operation of servomotor 111, independently of servomotor 95, so that the position of the leading lugs 78 is varied with respect to the trailing lugs 44 of the overhead flight conveyor assembly. This is how the width, or pitch, of the pocket formed between the respective trailing lugs, and leading lugs, is formed. During this operation, the trailing lugs will remain in a stationary reference or "home" position.

In known fashion, servomotors 95, 111 of the respective drive systems will be in communication with a control processor, for example a computer, used to operate packaging machine 7. It is anticipated that the computer will have a computer readable medium, for example a floppy disc drive, or a hard drive, in which a pre-programmed data or position table is stored correlating the position of the respective trailing and leading lugs with respect to one another for a variety of carton sizes and packaging configurations, and thus for varying the pockets formed by the overhead flight conveyor assembly based on the size of the cartons being carried along the carton transport conveyor, in conjunction with the groups of articles being packaged. For example, the width of the pockets formed between the trailing and leading lugs would be varied when six-packs, nine-packs, twelve-packs, fifteen-packs, eighteen-packs, and twenty-four-packs (cases) are being packaged on the packaging machine. In all instances, however, during operation of the overhead flight conveyor assembly, the trailing lugs assembly drive system 94 and the leading lug assembly drive system 110 are operated in synchronization with one another so that there is no speed variation between the movement of the trailing lugs and the leading lugs, respectively, all lugs moving at the same rate of speed along the path of travel.

Also, it is anticipated that a series of "split" pockets could be formed of a second pitch, or width, along the length of the respective trailing and leading lug assemblies. For example, a first series of spaced trailing lugs 56 is illustrated in FIGS. 1 and 2. In similar fashion, a first series of spaced leading lugs 78 is illustrated in FIGS. 1 and 2. Assuming these leading and trailing lugs are on twelve-inch centers, a second series of trailing lugs could be positioned intermediate the trailing lugs of the first series of trailing lugs along each of conveyor chains 45, 48, respectively, and in similar fashion, a second series of leading lugs 78 could be positioned intermediate the leading lugs of the first series of leading lugs on conveyor chains 65, 68, respectively, as illustrated in FIGS. 5A and 5B for example. Accordingly, in FIGS. 5A and 5B the lugs would then be on six-inch centers as opposed to being on twelve-inch centers so that a split pocket has been formed having a pitch half the pitch of the pockets of the trailing and leading lugs assemblies illustrated in FIGS. 1 and 2. The decision to use a split pocket, as known to those of skill in the art, is based upon the size of the article grouping being packaged, and the accompanying size of the paperboard carton 16 in which the articles are to be packaged. For example, when a case of twenty-four articles is being packaged, the leading and trailing lugs will typically be on twelve-inch centers, whereas the trailing and leading lugs will typically be on six-inch centers, respectively, when a six-pack is being packaged. The concept and theory of operation behind split pockets is described in greater detail in U.S. Pat. No. 5,501,318, disclosed above, and incorporated herein by reference.

Lastly, and as shown in FIG. 1 it is anticipated that housing 34 will extend substantially along the length of carton transport conveyor 12, and may extend the entire length if so desired. Trailing lug assembly 44 is shown extending along substantially the length of housing 34, although this is not necessarily required. However, leading lug assembly 64 is shown as extending only partially along the length of trailing lug assembly 44, it being anticipated that in this construction leading lug assembly 64 will only be used for the purposes of completing the erection of carton 16 within pockets 15 of carton transport conveyor 12, and that once fully erected and after the articles from the article selector device (not illustrated) have been transferred into the cartons, the respective cartons, now weighted with the articles, will no longer require the leading lug assembly to maintain the carton in its erected/tapered configuration. Accordingly, the leading lugs are passed over respective ones of drive sprockets 71, 72, and moved back toward the tension-guide blocks provided at the first end 35 of housing 34 for each respective conveyor chain 65, 68 of the leading lug assembly. However, although the leading edge assembly is shown as extending along only a portion of the length of the trailing lug assembly, it is anticipated that the leading lug assembly may be extended the length of the trailing lug assembly on housing 34 if so desired, such a configuration offering the benefit of supporting the erected and tapered carton as its end flaps are folded and glued downstream of the article selector. Moreover, both of the leading and trailing lug assemblies may extend together along the entire length of housing 34, if so desired.

Figure 8:
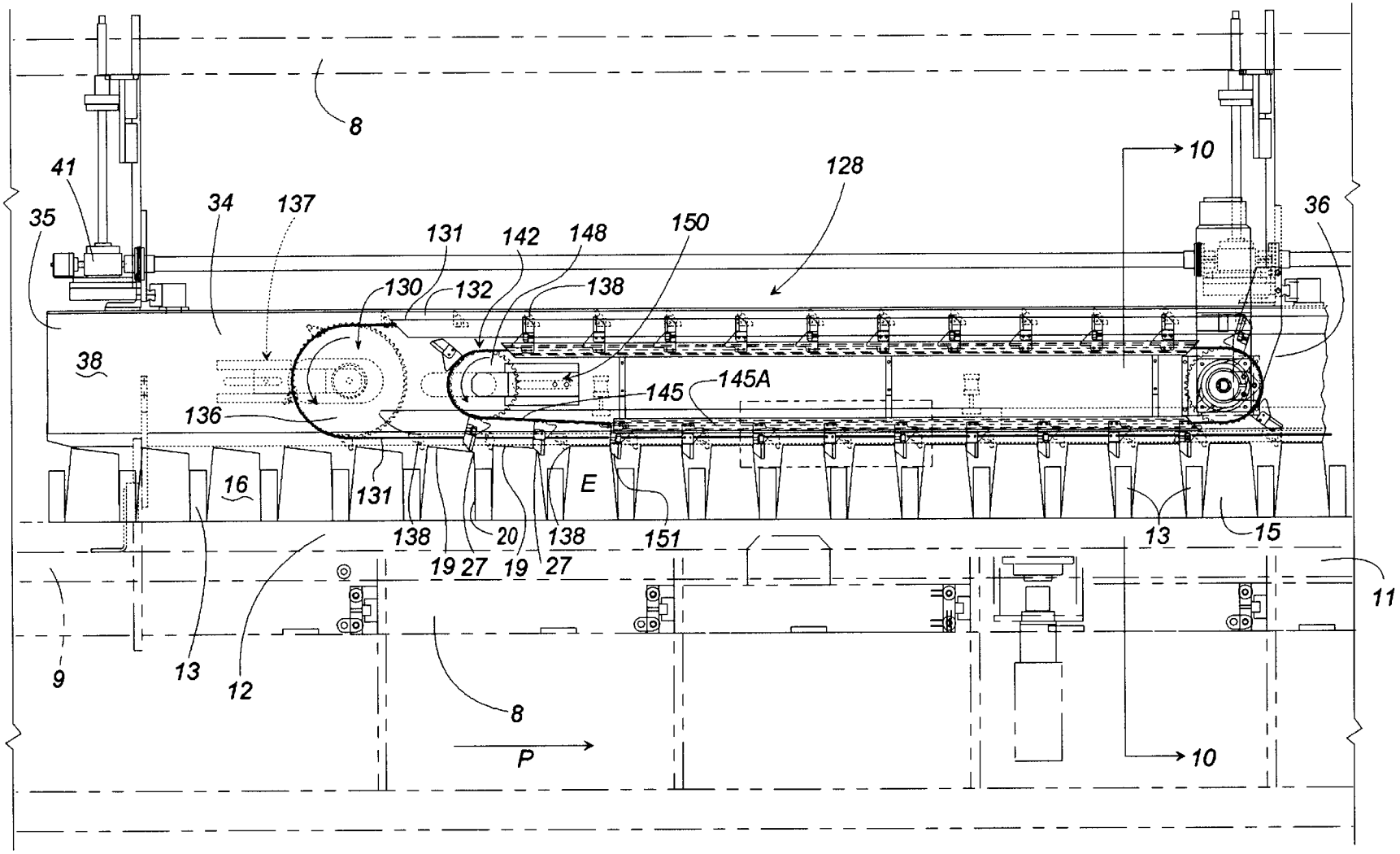
FIG. 8 illustrates a side elevational view of a second embodiment of the improved overhead flight conveyor assembly of this invention.

A second embodiment of overhead flight conveyor assembly 128 is illustrated in FIGS. 8–11. Turning first to FIG. 8 overhead flight conveyor assembly 128 is shown for use with a continuous motion packaging machine 7 again having a framework 8, with an infeed end 9 and a spaced discharge end 11. A series of folded, substantially flat paperboard cartons (not illustrated) will be held in a carton supply magazine (not illustrated) upstream of infeed end 9 of the packaging machine, with a carton feed-erector device (not illustrated) positioned intermediate the carton supply magazine and the infeed end of the packaging machine, whereupon a series of at least partially erected cartons 16 are placed within the respective pockets 15 formed by the lugs 13 of the carton transport conveyor, and moved along the path of travel denoted by the reference character "P" in FIG. 8.

As shown in FIG. 8 trailing lug assembly 130 includes a first endless conveyor chain 131 held within an elongate chain track 132, and a second, spaced parallel endless conveyor chain 134 (FIG. 10) held within an elongate chain track 135 (FIG. 10) for movement along the path of travel. A tension or idler sprocket 136 is provided at the first end 35 of housing 34 for such chain, although only one idler sprocket is shown for conveyor chain 131 for the sake of clarity in FIG. 8. A second identical sprocket is provided, although not illustrated, for conveyor chain 134. Sprocket 136 is used with a tensioning assembly 137 for tensioning conveyor chain 131. A second tensioning assembly (not illustrated) is provided for conveyor chain 134.

Trailing lug assembly 130 includes a spaced series of trailing lugs 138 for being moved along the path of travel, and fastened to conveyor chains 131, 134, respectively. Each of trailing lugs 138 has a carrier 139, to which the trailing lug is fastened, the carrier 139 in turn being fastened to the respective conveyor chains. Trailing lug assembly 130 is constructed in the same fashion as trailing lug assembly 44 of FIGS. 1A–6.

Figure 9:
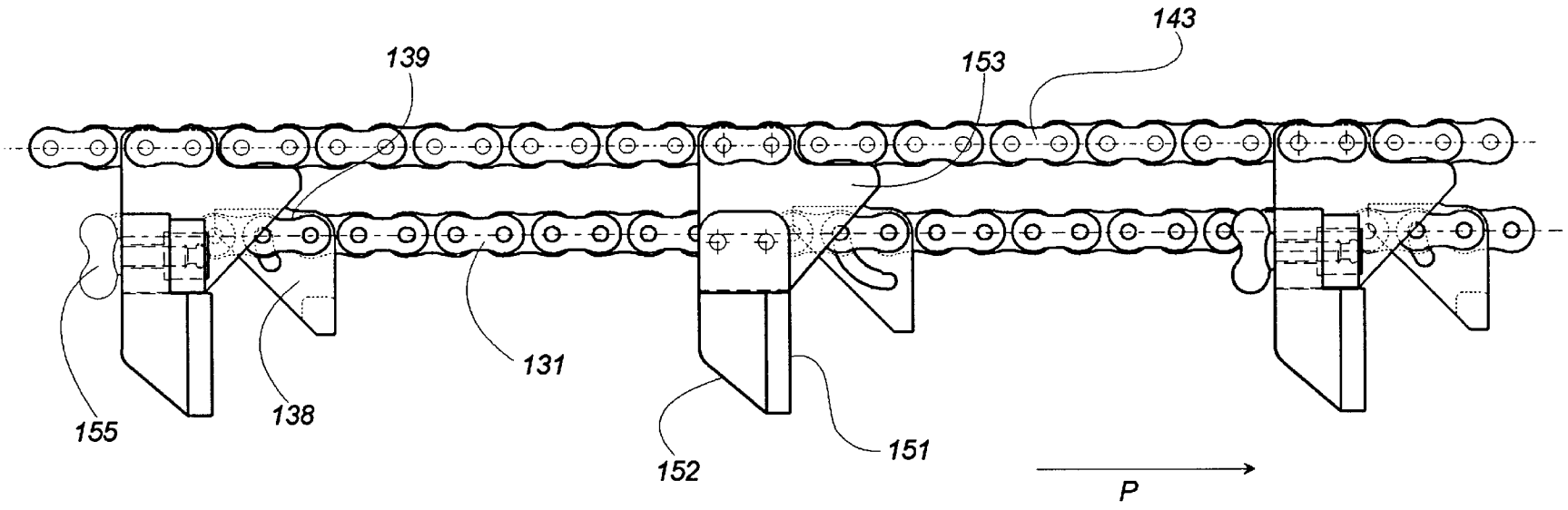
FIG. 9 is an enlarged partial side elevational view of the leading lug conveyor chain and leading lugs affixed thereto, and of the trailing lug conveyor chain and the trailing lugs affixed thereto of the overhead flight conveyor assembly of FIG. 8.
Figure 10:
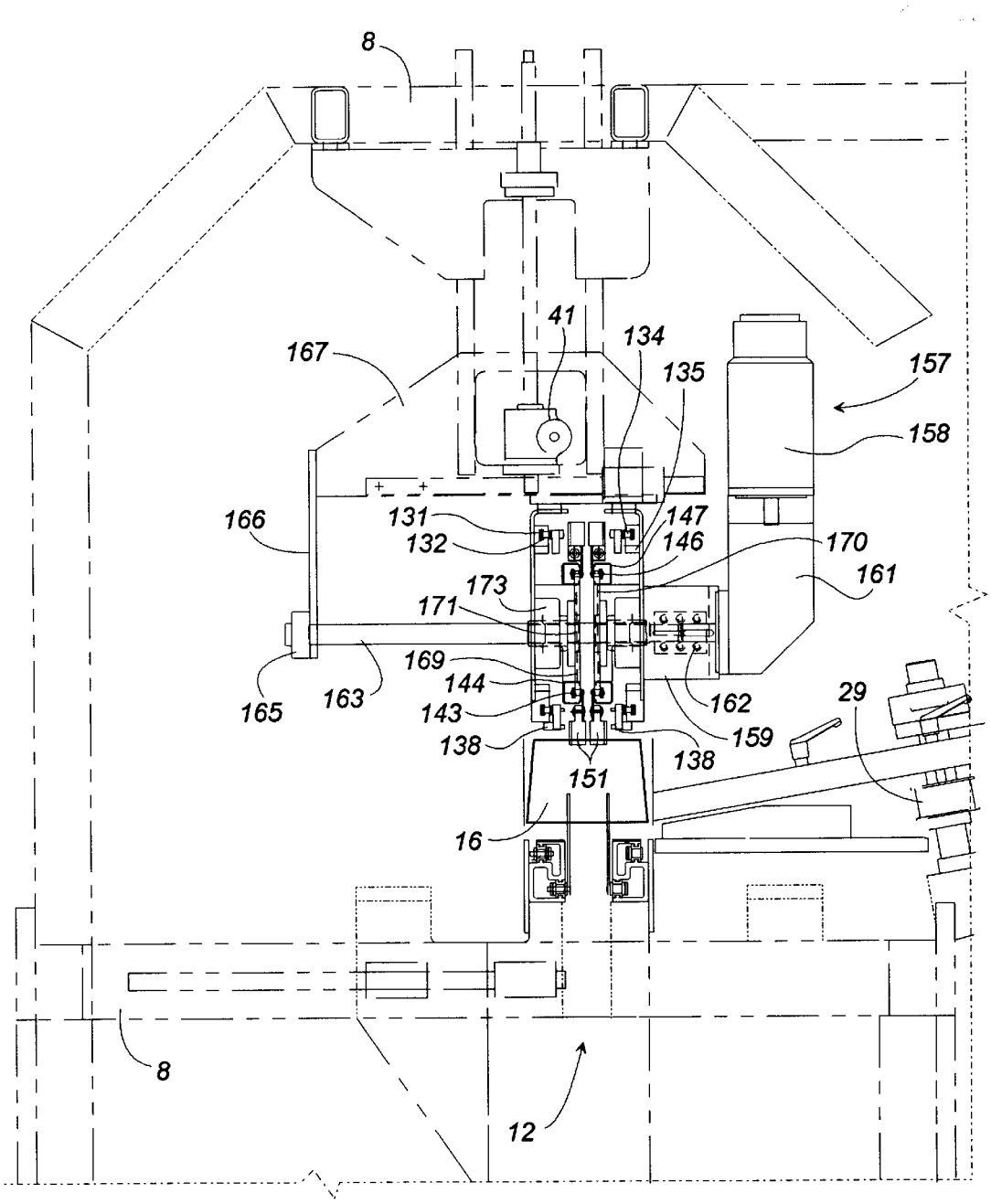
FIG. 10 is a partial cross-sectioned elevational view along line 10—10 illustrating the leading lug assembly drive system of the overhead flight conveyor system of FIG. 8.

As shown in FIGS. 8–10, overhead flight conveyor assembly 128 of the second embodiment of the invention includes a leading lug assembly 142, having a first conveyor chain 143 held within a first elongate chain track 144, and a second spaced, parallel conveyor chain 146 held within a second elongate chain track 147. Each of chain tracks 132 and 135 for the trailing lug assembly 130, and chain tracks 144 and 147 for leading lug assembly 142, are milled out of elongate blocks of ultra-high molecular weight plastic, the chain tracks/plastic in turn being fastened to the respective side panels (FIG. 3) forming a part of housing 34, although no cam track 90 is provided with this second embodiment of the overhead flight conveyor assembly.

Rather, and as best shown in FIG. 8, and referring specifically to first conveyor chain 143, although an identical arrangement is provided for conveyor chain 146, the conveyor chain has a first ramped portion 145 which is inclined with respect to the plane of travel defined by the downstream, or straight portion 145*a* of the conveyor chain extending within chain track 144 along and in the direction of the path of travel from the tension end 35 toward the drive end 36 of housing 34. So constructed, ramped portion 145 occupies a first plane of travel with respect to a second plane of travel defined by the straight portion 145*a* of conveyor chain 143, such that the leading lugs 151 travel along an inclined or ramped portion of the chain path, and then proceed along a second or straight portion which is parallel to the plane of travel defined by conveyor chains 131 and 134 of the trailing lug assembly.

Still referring to FIG. 8, the leading lug assembly includes a pair of tension sprockets, although only one tension sprocket 148 is illustrated in FIG. 8, with a tensioning assembly 150 providing an appropriate amount of tension for each of the conveyor chains 143, 146, although only one tensioning assembly for chain 143 is illustrated. A spaced series of leading lugs 151 are fastened to conveyor chains 143, 146, as illustrated in greater detail in FIG. 9. In this embodiment of the invention, each leading lug 151 has a profiled rear surface 152 which acts as a cam as no cam profile, nor cam track is provided to control the motion of the leading lugs along the path of travel. Each leading lug is fastened to a carrier 153, and may be fastened to carriers 153 with a quick release fastener 155, when, for example, it is desired to remove every other leading lug 151 for forming full pocket on twelve-inch centers as opposed to a split pocket on six-inch centers shown in FIG. 9. The trailing lugs 138 shown in FIG. 9 are constructed in fashion identical to the trailing lugs 56 of the first embodiment of the invention, and thus can have the feature of being able to move into extended and retracted positions as they are moved in the direction of the path of travel, and returned toward the tension end of the housing, respectively, as described in U.S. Pat. No. 5,501,318, incorporated herein by reference. Moreover, although not illustrated in FIG. 9, trailing lugs 138 could be provided with a quick release fastener (not illustrated).

A drive system 157 for leading lug assembly 142 is illustrated in FIG. 10, which in many aspects resembles the leading lug assembly drive system 110 for the first embodiment of the invention. Accordingly, the leading lug assembly drive system has a servomotor 158, the servomotor being fastened to a right angle gear drive, the entire assembly itself being supported by a servomotor mount 159 on housing 34. A coupling 162 is provided for fastening spline shaft 163 to the right angle gear drive, with a bearing 165 fastened to the end of shaft 163 opposite the coupling, and a shaft support arm 166 for supporting the spline shaft with respect to housing 34. An overhead lift support 167 is fastened to housing 34 for raising and lowering the housing when so desired using lift drive system 41, the operation of which is described in greater detail in U.S. patent application Ser. No. 08/660,482, incorporated herein by reference.

Still referring to FIG. 10, a pair of hubs 171 are provided for fastening drive sprockets 169 and 170 to shaft 163, the two drive sprockets being spaced from, and parallel to one another, and being rotated together in unison by servomotor 158. Hubs 171 may be splined to shaft 163, although they may otherwise be keyed or conventionally fastened to the shaft as so desired. Shaft 166 is supported for rotation on housing 34 by a pair of bearing assemblies 173, the bearing assemblies comprising conventional roller bearings.

Figure 11:
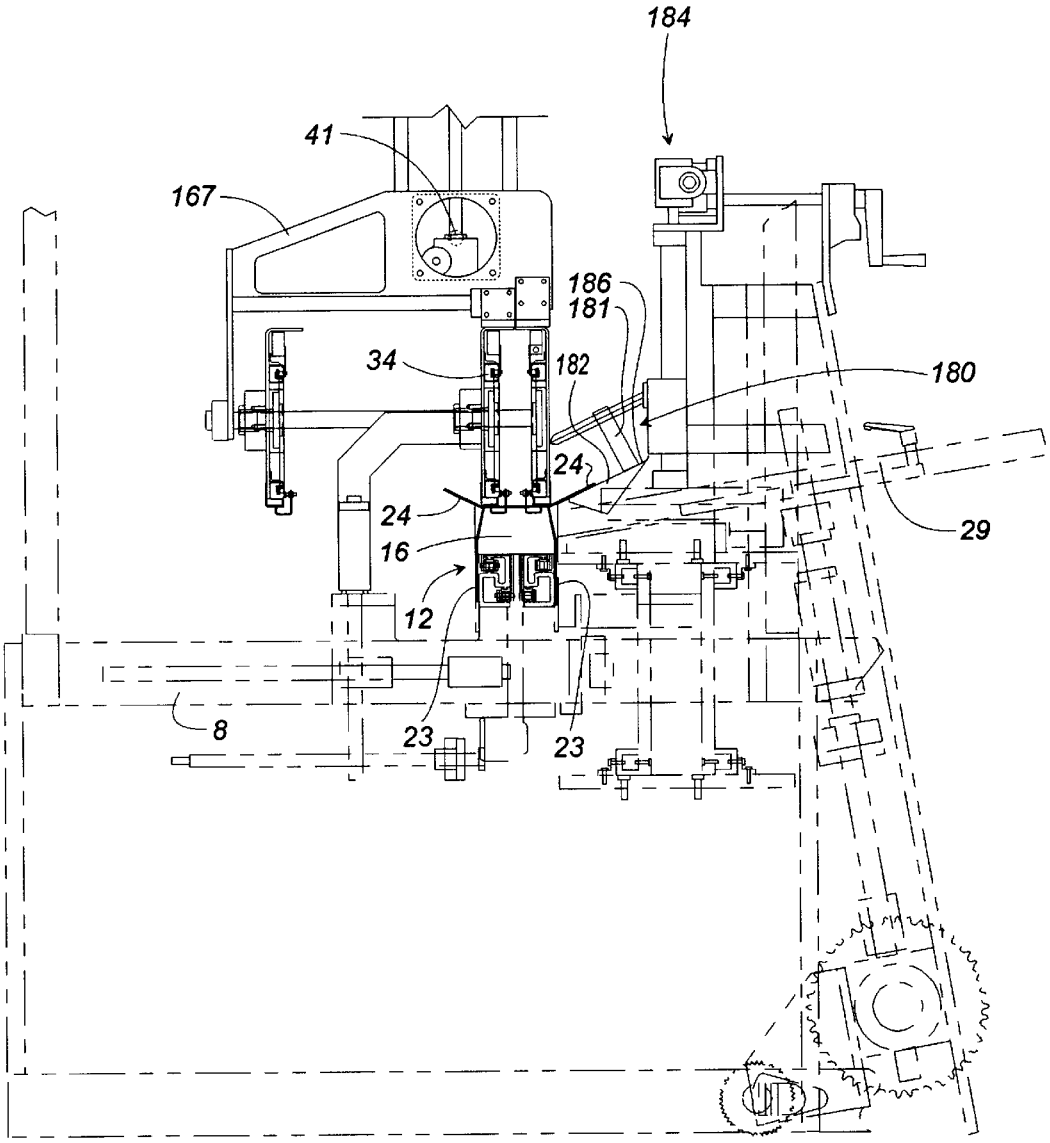
FIG. 11 is a partial end elevational view, partially in cross-section, of the overhead flight conveyor assembly of FIG. 8.

Referring now to FIG. 11, and as shown also in FIG. 8, separate leaf spring assemblies 180, each of which is comprised of a pair of spaced and parallel leaf springs 181, are positioned on framework 8 on opposite sides of housing 34, at approximately the first end of 35 thereof, in spaced relationship to the carton transport conveyor 12, and to a pair of top end flap guides 186 mounted on the framework of the packaging machine, one top end flap guide being provided on each side of the carton transport conveyor with respect to housing 34. Leaf springs 181 of leaf spring assembly 180 are comprised of flat steel leaf springs, each fastened to a bracket 182, and being capable of adjustment along the path of travel by a leaf spring adjustment system 184 provided for the purpose of positioning the respective leaf spring assemblies along the path of travel so that the top end flaps 24 of the respective carton 16 being moved along the path of travel are pinched between the leaf springs and the top end flap guides for momentarily retarding the movement of top panel 19 along the path of travel with respect to the movement of bottom panel 18 along the path of travel to assist in the positioning of leading lugs 151 as they come down from above, and over the top panel and into engagement with the front side panel 20, and the false score line 27 of carton 16 to assist in the erection of the cartons prior to the placement of articles therein by the article selector device (not illustrated).

As illustrated in FIG. 8, leaf spring assembly 180, and particularly leaf springs 181 thereof, extend for approximately four inches in the direction of the path of travel against top end flap guide 186, and are provided for only momentarily retarding the progress of top panel 19 along the path of travel, as opposed to halting the top panel which would otherwise have the effect of pulling the cartons out of the pockets 15 on carton transport conveyor 12. By momentarily retarding the progress of the top panel along the path of travel, leading lugs 151 are allowed to strike the front side panel and false score line of the carton, rather than being allowed to possibly strike the top panel of the carton, which would have the undesired effect of collapsing the carton.

Although leaf springs 181 have been described above as being flat steel leaf springs, it is anticipated they could be constructed of a suitable resilient, durable plastic material if so desired. Moreover, a trailing lug assembly drive system is provided for the second embodiment of the overhead flight conveyor assembly of FIGS. 8–11, but is not illustrated as it is anticipated that this drive assembly system would be constructed in fashion identical to either of drive systems 94, 110 of the first embodiment of the invention, illustrated in FIG. 4.

OPERATION

The operation of the preferred embodiments of the overhead flight conveyor assembly of this invention will now be described in greater detail.

Turning first to the operation of the first preferred embodiment of overhead flight conveyor assembly 5 of FIGS. 1–6, separate ones of carton 16 are removed from a carton supply magazine (not illustrated), in which the cartons are held in a substantially flat condition, by a carton feed-erection device (not illustrated) positioned downstream of the carton supply magazine and upstream of the infeed end 9 of packaging machine 7. The cartons are withdrawn from the supply magazine and moved along the path of travel by the carton feed-erection device, so that a leading edge of the carton, typically the false score line 27 and the front side panel 20 of carton 16, engages a leading lug 13, whereupon a trailing lug 13 of carton transport conveyor 12 comes into contact with the hinged connection of the bottom panel 18 to the rear side panel 22, and acts to at least partially open, i.e. erect, carton 16 within the pockets 15 of the carton transport conveyor, and moves the partially erected cartons in spaced series thereon and in the direction of the path of travel toward overhead flight conveyor assembly 5.

Thereafter, as best shown in FIGS. 1 and 2, a trailing lug 58 is moved from the tension end 35 toward the drive end 36 of housing 34, so that the lug engages the rear side panel 22 (FIG. 7) of a carton 16. Although a single trailing lug 56 is referred to herein, it is understood by reference to the drawings, and by the disclosure hereinabove, that a pair of spaced and parallel conveyor chains 45, 48, having a first series of parallel trailing lugs 56 on each such chain are moved in unison along the path of travel. In similar fashion, although a single leading lug 78 will be referred to hereinafter, it is understood that a spaced and parallel pair of leading lugs is being moved on conveyor chains 65 and 68, respectively, along the path of travel.

Once the trailing lug 56 engages the rear side panel of the carton, the carton is moved in the pocket of the carton transport conveyor in known fashion and toward the article selector device (not illustrated) downstream of the tension-guide block 73 of leading lug assembly 64. As carton 16 is being moved along the path of travel, however, a leading lug 78 is also being moved along the path of travel spaced above, and in timed relationship, with the movement of the trailing lug and the carton. This is accomplished by the cam roller 88 of carrier 82 being received within cam track 90, such that the carrier 82 is pivoted about pivot pin 84 along the path prescribed by arcuate slot 87, with guide pin 86 received therein. This has the effect, as shown in FIG. 2, of inclining the distal end of leading lug 78 in the direction of the path of travel and spacing the entire leading lug above the top panel 19 of the carton as both move along the path of travel.

Thereafter, as the leading lug continues to move along the path of travel within cam track 90, the cam roller is guided by cam profile 92 such that the distal end of leading lug 78 begins to follow an arcuate path, designated by the reference character "A" in FIG. 2, toward and into engagement with the front side panel 20 and false score line 27 defined therein for the purpose of pushing the front side panel toward the rear side panel, and unfolding the false score in the front panel such that the top panel of the carton is moved into position where it is parallel to the bottom panel in the erected position of the carton indicated by the reference character "E" in FIG. 2. Once the distal end 79 of leading lug 78 engages the front side panel and false score line of the carton, the leading lug continues to move toward the rear lug until the cam roller 88 completes moving through the cam profile 92, such that the leading lug is in a vertical position with respect to the vertical position of the trailing lug 56, as shown in FIG. 2, thus locking the top panel of the carton 16 into position between the pocket formed between the leading lug and trailing lug, until such time as the appropriate number of articles have been moved by the article selector device (not illustrated) into the carton, whereupon the leading lug is then withdrawn from the front side panel of the carton by being passed over a respective one of the drive sprockets 71, 72 (FIGS. 1–6) respectively and back along the path of travel toward the tension end 35 of housing 34.

The amount of inclination of the distal end 79 of leading lug 78, as well as the degree of travel along arcuate path A is defined by the length of carrier 82, the length of arcuate slot 87, and the distance between pivot pin 84 and guide pin 86, in conjunction with the actual length of leading lug 78, which will impact how far the leading lug will travel along the arcuate path to engage the front side panel and false score line of the carton. In addition, this can also be affected by the cam profile 92 designed into the cam track 90, which will also impact the speed at which the leading lug will come down into engagement with the carton depending on how gradually the cam profile is sloped, or how steeply it is sloped, as well as the horizontal/spatial difference between the travel planes of the cam track 90 upstream of the cam profile 92, and the cam track 90 downstream of the cam profile, i.e. the two different horizontal planes formed by these two portions of the cam track with respect to one another, the transition of the cam follower from the first plane to the second plane of the cam track being accomplished by moving the cam roller along cam profile 92.

In the second embodiment of overhead flight conveyor assembly 128 illustrated in FIGS. 8–11, the method of erecting the carton is similar in that the leading lug is moved over the top panel of the carton and then downwardly toward and into engagement with the front side panel and false score line defined therein as the carton moves along the path of travel, although this method is accomplished using a different series of steps based on the different structure of the second embodiment of the invention.

Therefore, referring first to FIG. 8 a series of partially erected cartons 16 are being carried in the pockets 15 of carton transport conveyor 12 along the path of travel. As the cartons move along the path of travel, a trailing lug 138, it again being understood that there is a pair of spaced and parallel trailing lugs being moved together, engages the rear side panel 22 (FIG. 7) of carton 16 to ensure that the carton is moved within pocket 15, and not otherwise allowed to be pulled, or fall out of the pocket as the empty cartons move along the carton transport conveyor. Thereafter, a leading lug 151, one of a pair of spaced, parallel leading lugs, is moved in timed relationship with the movement of trailing lug 138 along the path of travel spaced above, and with, the movement of the carton on the carton transport conveyor. As the leading lugs are passed over tension sprocket 148, the conveyor chain 143 follows a ramped portion 145 of the chain path from the sprocket toward the chain track 144, the chain track being parallel to the carton transport conveyor 12 as well as to conveyor chains 131, 134 such that ramped portion 145 of conveyor chain 143 is inclined with respect to the second straight downstream portion 145*a* of conveyor chain 143 thus defining first and second planes of travel with respect to one another, the second plane of travel along straight portion 145*a* and being parallel to the plane of travel followed by trailing lugs 138 within chain tracks 132 and 135.

Therefore, as leading lug 151 moves along ramped portion 145 it is progressively moved toward, and into engagement with the front side panel and false score line defined therein of carton 16, as shown sequentially in FIG. 8. As leading lug 151 has a profiled rear surface 152 (FIG. 9) having a cam profile defined thereon, the movement of the leading lug along the path of travel and progressively toward and into engagement with the front side panel false score line acts to progressively erect carton 16 within pocket 15, as shown in FIG. 8 until such time as leading lug 151 begins passing along straight portion 145*a* of chain track 144, thus locking the top panel of carton 16 between the respective trailing lugs 138 and leading lugs 151 of the series of trailing and leading lugs, respectively, along the length of the leading lug assembly until such time as the carton 16 is supplied with a series of articles (not illustrated) passed therein from the article selector device (not illustrated), whereupon the leading lugs are withdrawn from engagement with the front side panel of the carton as they are passed upwardly over the respective drive sprockets 169, 170 (FIG. 10) and begin the return leg from the drive sprocket back toward the tension sprockets of the leading lug assembly.

It is anticipated that ramped portion 145 of conveyor chain 143, a similar ramped portion being provided for conveyor chain 146 (FIGS. 10, 11), will be angled at approximately 5° away from housing 34 toward carton transport conveyor 12 to guide leading lug 151 into engagement with carton 16. The speed with which the leading lug will engage the carton can be varied by increasing the angle of the ramped portion with respect to the carton transport conveyor, as well as by varying the size of leading lug 151 and the profiled 152 formed on the rear surface of the leading lug, these two factors working together to determine how fast the carton is erected, and to what extent the front panel is pushed toward the rear panel of the carton during the erection process.

The method used with the second embodiment of overhead flight conveyor assembly 128 of FIGS. 8–11 requires that a pair of leaf spring assemblies 180 be positioned on opposite sides of the carton transport conveyor, spaced above a pair of top end flap guides spaced on opposite sides of the carton transport conveyor, so that as the partially erected cartons are moved along the path of travel upstream of the article selector (not illustrated), the top end flaps are guided up onto the top end flap guides in known fashion, and are passed thereover as the carton moves toward the leading lug assembly 142. Prior to leading lug 151 engaging the carton 16, the pair of leaf springs 181 provided as part of each leaf spring assembly 180 (FIG. 11) will pinch the top end flap 24 (FIG. 7) at each opposed end of the top panel 19 against the top end flap guide to momentarily retard the movement of the top panel 19 with respect to the bottom panel 18 along the path of travel such that when the leading lug first strikes the front side panel and false score line of the carton, it will not otherwise strike the top panel of the carton thus ensuring that the carton is erected, rather than collapsed within pocket 15. So constructed, the leaf springs will pinch the top end flaps against the top end flap guide for approximately four inches of travel along the path of travel, immediately prior to the engagement of the leading lug on the front side panel and false score line of the carton.

While preferred embodiments of the invention have been disclosed in the foregoing Specification, it is understood by those skilled in the art that variations and modifications thereof can be made without departing from the spirit and scope of the invention, as set forth in the following claims. In addition, the corresponding structures, materials, acts, and equivalents of all means or step plus function elements in the claims, below, are intended to include any structure, material, or acts for performing the functions in combination with other claimed elements, as specifically claimed herein.

I claim:

1. An overhead flight conveyor assembly for use with a packaging machine in erecting a 4-sided tapered paperboard carton, the packaging machine having an elongate carton transport conveyor supported on a framework of the packaging machine and moving along a path of travel, the carton transport conveyor being supplied with and carrying at least one partially erected carton thereon, and a pair of top end flap guides supported on the framework with respect to the carton transport conveyor, each carton having a bottom panel, a spaced top panel, a front side panel and a spaced and opposed rear side panel each of which is hingedly joined to the bottom panel and to the top panel, respectively, an elongate false score line defined in the front panel of the carton spaced from and parallel to the top panel thereof, and bottom and spaced top end flaps hingedly connected to the bottom and top panels, respectively, at each opposed end of the carton, the side panels and end flaps of the carton extending inwardly toward the top panel with respect to one another when the carton is in its tapered configuration, said overhead flight conveyor assembly comprising:

a) a housing supported on the framework of the packaging machine spaced above the carton transport conveyor and extending along substantially the length of the carton transport conveyor, said housing having a first end and a spaced second end;

b) a trailing lug assembly supported on said housing and extending at least partially along the length thereof, said trailing lug assembly having at least one elongate first conveyor chain with a first series of spaced trailing lugs affixed thereto and being moved in the direction of the path of travel in timed relationship with the carton transport conveyor;

c) a leading lug assembly supported on said housing and extending at least partially along the length of said trailing lug assembly, said leading lug assembly having at least one second elongate conveyor chain with a first series of spaced leading lugs affixed thereto and being moved in the direction of the path of travel in timed relationship with said trailing lugs;

d) said trailing lug assembly being constructed and arranged to move a respective one of said trailing lugs into engagement with the rear side wall of the carton as the carton advances along the path of travel on the carton transport conveyor;

e) said leading lug assembly being constructed and arranged to carry a respective one of the leading lugs over the top panel of the carton as the carton advances along the path of travel and to move said leading lug toward and into engagement with the front side panel of the carton and the false score line wherein said leading lug unfolds the score line for completing erection of the carton into its tapered configuration.

2. The overhead flight conveyor assembly of claim 1, wherein said trailing lug assembly extends the length of said housing.

3. The overhead flight conveyor assembly of claim 1, said at least one first conveyor chain comprising a spaced and parallel pair of first conveyor chains, said pair of first conveyor chains being constructed and arranged to be moved together in the direction of the path of travel.

4. The overhead flight conveyor assembly of claim 1, wherein the leading lugs of said series of leading lugs are alternately spaced with said trailing lugs, respectively, along the length of said leading lug assembly for forming a series of spaced pockets along the length of said leading lug assembly of a first pitch.

5. The overhead flight conveyor assembly of claim 4, wherein:

said trailing lug assembly includes a second series of spaced trailing lugs removably affixed to said at least one first conveyor chain, the respective trailing lugs of said second series of trailing lugs being alternately spaced with respective ones of the trailing lugs of said first series of spaced trailing lugs;

wherein said leading lug assembly includes a second series of spaced leading lugs removably affixed to said at least one second conveyor chain, the respective leading lugs of said second series of leading lugs being alternately spaced with respective ones of the leading lugs of said first series of spaced leading lugs; and wherein the respective trailing lugs and the leading lugs of said first and of said second series of trailing and leading lugs, respectively, form a series of split pockets of a split pitch therebetween along the length of said leading lug assembly.

6. The overhead flight conveyor assembly of claim 4, said leading lug assembly being constructed and arranged to variably space said leading lugs from said trailing lugs to vary the size of said pockets along the length of said trailing lug assembly.

7. The overhead flight conveyor assembly of claim 1, said at least one second conveyor chain of the leading lug assembly being spaced from and parallel to said to at least one first conveyor chain of said trailing lug assembly.

8. The overhead flight conveyor assembly of claim 1, said at least one second conveyor chain comprising a spaced and parallel pair of second conveyor chains, said pair of second conveyor chains being constructed and arranged to be moved together in the direction of the path of travel.

9. The overhead flight conveyor assembly of claim 1, said leading lug assembly including at least one cam assembly, said at least one cam assembly including an elongate cam track extending from the first end toward the second end of said housing in the direction of the path of travel along the length of said leading lug assembly, said cam track being supported on said housing with respect to said at least one second conveyor chain, said cam track defining a predetermined cam profile therein for controlling the movement of said leading lugs, wherein each said leading lug has a proximal end and a spaced distal end, the proximal end of each said lug being affixed to a lug carrier and the distal end thereof extending away from said lug carrier, each said lug carrier being pivotally affixed to said at least one second conveyor chain and having a cam follower for being guided within said cam track.

10. The overhead flight assembly of claim 9, wherein said cam profile is constructed and arranged to first pivotally incline the distal end of said leading lug in the direction of the path of travel as said lug moves therealong for holding the distal end of said lug spaced above the top panel of the carton being carried on the carton transport conveyor, to next move the distal end of said lug along an arcuate path toward and into engagement with the front panel and the false score line defined therein, and once said lug engages the front panel of the carton to move the distal end of said lug toward the rear panel of the carton to complete erection of the carton.

11. The overhead flight assembly of claim 10, said leading lug assembly further comprising a spaced and parallel pair of said second conveyor chains, said pair of second conveyor chains being constructed and arranged to be moved together in the direction of the path of travel, and a pair of said cam assemblies, one each of said cam assemblies being used with a respective one of each said second conveyor chain.

12. The overhead flight conveyor assembly of claim 1, wherein:

each said leading lug has a proximal end and a spaced distal end, the proximal end of each said lug being affixed to a lug carrier and the distal end thereof extending away from said lug carrier, each said lug carrier being affixed to said at least one second conveyor chain;

wherein said at least one second conveyor chain has a first ramped portion at the first end of said housing inclined away from said housing and extending in the direction of the path of travel, and a second portion extending from said first portion toward the second end of said housing in the direction of the path of travel, said second portion being parallel to said at least one first conveyor chain of said trailing lug assembly;

and wherein said leading lug is progressively moved along said first ramped portion from a position spaced above the top panel of the carton into engagement with the front panel and the false score line defined therein.

13. The overhead flight assembly of claim 12, wherein said leading lug has a profiled rear surface sized and shaped to progressively unfold the false score line in the carton for erecting the carton as the leading lug is moved along said ramped portion in engagement with the front panel of the carton so that erection of the carton is completed once the leading lug starts to travel along said second portion of said second conveyor chain.

14. The overhead flight assembly of claim 12, wherein said first ramped portion is angled away from said housing at an angle of five degrees.

15. The overhead flight assembly of claim 12, wherein each respective top end flap of the carton is passed over and rides on a respective one of the top end flap guides as the carton is moved toward the leading lug assembly, and wherein at least one leaf spring momentarily pinches each respective top end flap against the respective top end flap guides as said leading lug is moved over the top panel of the carton to retard the movement of the top panel of the carton with respect to the movement of the bottom panel along the path of travel prior to said leading lug engaging the front panel of the carton.

16. A method of using an overhead flight assembly for erecting a 4-sided tapered paperboard carton on a packaging machine, the packaging machine having a framework, an elongate carton transport conveyor supported on the framework and moving along a path of travel, the overhead flight conveyor assembly being positioned in a housing supported on the framework spaced above, in alignment with, and extending at least partially along the length of the carton transport conveyor, and a pair of top end flap guides supported on the framework with respect to the carton transport conveyor, the carton having a bottom panel, a spaced top panel, a front side panel and a spaced and opposed rear side panel each of which is hingedly joined to the bottom panel and to the top panel, respectively, an elongate false score line defined in the front panel of the carton spaced from and parallel to the top panel, and bottom and spaced top end flaps hingedly connected to the bottom and top panels, respectively, at each opposed end of the carton, the side panels and end flaps of the carton extending inwardly toward the top panel with respect to one another when the carton is in its tapered configuration, said method comprising the steps of:

a) moving a partially erected carton on the carton transport conveyor in the direction of the path of travel, b) moving a trailing lug provided as a part of a trailing lug assembly supported on the housing in the direction of the path of travel in timed relationship with the movement of the carton transport conveyor and into engagement with the rear side panel of the carton as the carton advances along the path of travel; and c) moving a leading lug provided as a part of a leading lug assembly supported on the housing and extending at least partially along the length of said trailing lug assembly, and spaced from said trailing lug, in timed relationship with the movement of the trailing lug in the direction of the path of travel and over the top panel of the carton as the carton advances along the path of travel, and then moving said leading lug toward and into engagement with the front side panel and the false score line to unfold the false score line in the front panel for erecting the carton into its tapered configuration.

17. The method of claim 16, step c) further comprising the steps of:

i) pivotally inclining said leading lug in the direction of the path of travel as said lug moves along the path of travel and holding a distal end of said leading lug spaced above the top panel of the carton being carried on the carton transport conveyor;

ii) moving said distal end along an arcuate path toward the front panel of the carton and then moving the distal end of said leading lug into engagement with the false score line and the front panel in response thereto; and iii) continuing to move the distal end of said lug toward the rear panel of the carton and completing erection of the carton into its tapered configuration in response thereto.

18. The method of claim 16, step c) further comprising the steps of:

i) moving said leading lug along an incline extending in the direction of the path of travel and away from said housing ii) progressively moving said leading lug along said incline from a position spaced above the top panel of the carton being moved on the carton transport conveyor into engagement with the front panel and the false score line in response thereto; and iii) engaging the front panel and the false score line with a profiled rear surface of said leading lug and progressively unfolding the false score line in the carton and erecting the carton as the leading lug is moved along said incline.

19. The method of claim 18, further comprising the steps of;

i) positioning each of the two spaced top end flaps of the carton on the spaced top end flap guides, respectively, of the packaging machine;

ii) momentarily pinching the flaps against each of the guides, respectively, with at least one leaf spring positioned on the packaging machine with respect to each of the top end flap guides and the carton transport conveyor; and iii) retarding the movement of the top panel of the carton with respect to the movement of the bottom panel along the path of travel in response thereto, prior to said leading lug engaging the front panel and the false score line of the carton.

20. A method of using an overhead flight assembly for erecting a 4-sided tapered paperboard carton on a packaging machine, the packaging machine having a framework, an elongate carton transport conveyor supported on the framework and moving along a path of travel, the overhead flight conveyor assembly being positioned in a housing supported on the framework spaced above, in alignment with, and extending at least partially along the length of the carton transport conveyor, and a pair of top end flap guides supported on the framework with respect to the carton transport conveyor, the carton having a bottom panel, a spaced top panel, a front side panel and a spaced and opposed rear side panel each of which is hingedly joined to the bottom panel and to the top panel, respectively, an elongate false score line defined in the front panel of the carton spaced from and parallel to the top panel, and bottom and spaced top end flaps hingedly connected to the bottom and top panels, respectively, at each opposed end of the carton, the side panels and end flaps of the carton extending inwardly toward the top panel with respect to one another when the carton is in its tapered configuration, said method comprising the steps of:

a) moving a partially erected carton on the carton transport conveyor in the direction of the path of travel, b) moving a series of spaced trailing lugs provided as a part of a trailing lug assembly supported on the housing in the direction of the path of travel in timed relationship with the movement of the carton transport conveyor;

c) moving a series of spaced leading lugs provided as a part of a leading lug assembly supported on the housing in the direction of the path of travel in timed relationship with the movement of said trailing lugs, said leading lug assembly extending at least partially along the length of said trailing lug assembly;

d) moving one of said trailing lugs into engagement with the rear side panel of the carton as the carton advances along the path of travel;

e) moving one of said leading lugs over the top panel of the carton as the carton advances along the path of travel, and then moving said leading lug toward and into engagement with the front side panel of the carton; and f) unfolding the false score line in the front panel of the carton in response thereto, thereby forming the carton into its tapered configuration.

21. An overhead flight conveyor assembly for use with a packaging machine in erecting a 4-sided tapered paperboard carton, the packaging machine having a framework, an elongate carton transport conveyor supported on the framework and moving along a path of travel, the carton transport conveyor carrying at least one partially erected carton along the path of travel, and a pair of top end flap guides supported on the framework with respect to the carton transport conveyor, each carton having a bottom panel, a spaced top panel, a front side panel and a spaced and opposed rear side panel each hingedly joined to the bottom panel and to the top panel, respectively, an elongate false score line defined in the front panel of the carton spaced from and parallel to the top panel thereof, and bottom and spaced top end flaps hingedly connected to the bottom and top panels, respectively, at each opposed end of the carton, the side panels and end flaps of the carton extending inwardly toward the top panel with respect to one another when the carton is in its tapered configuration, said overhead flight conveyor assembly comprising:

a) an elongate housing positioned on the framework of the packaging machine with respect to the carton transport conveyor;

b) a trailing lug assembly positioned within said housing and extending at least partially along the length of said housing, said trailing lug assembly having at least one elongate first conveyor chain with a first series of spaced trailing lugs affixed thereto;

c) a first drive assembly for moving said at least one first elongate conveyor chain in the direction of the path of travel;

d) a leading lug assembly positioned within said housing with respect to said trailing lug assembly, said leading lug assembly extending at least partially along the length of said trailing lug assembly and having at least one second elongate conveyor chain with a first series of spaced leading lugs affixed thereto;

e) a second drive assembly for moving said at least one second elongate conveyor chain in the direction of the path of travel in timed relationship with the movement of said at least one first elongate conveyor chain;

f) said trailing lugs and said leading lugs being spaced in alternating series with respect to one another along the length of said leading lug assembly;

g) said trailing lug assembly being constructed and arranged to move a respective one of said trailing lugs into engagement with the rear side wall of the carton as the carton advances along the path of travel on the carton transport conveyor;

h) said leading lug assembly being constructed and arranged to carry a respective one of said leading lugs over the top panel of the carton as the carton advances along the path of travel and to move said leading lug toward and into engagement with the front side panel of the carton and the false score line defined therein for completing erection of the carton into its tapered configuration by unfolding the false score line in the front side panel of the carton.

22. An overhead flight conveyor assembly for use in erecting 4-sided tapered paperboard cartons on a packaging machine, said overhead flight conveyor assembly comprising:

a) an elongate housing;

b) a trailing lug assembly positioned within said housing and extending at least partially along the length of said housing, said trailing lug assembly having at least one elongate first conveyor chain with a first series of spaced trailing lugs affixed thereto;

c) a first drive assembly for moving said at least one first elongate conveyor chain in the direction of the path of travel along a first plane of travel with respect to said housing;

d) a leading lug assembly positioned within said housing with respect to said trailing lug assembly, said leading lug assembly extending at least partially along the length of said trailing lug assembly and having at least one second elongate conveyor chain with a first series of spaced leading lugs affixed thereto;

e) a second drive assembly for moving said at least one second elongate conveyor chain in the direction of the path of travel in timed relationship with the movement of said at least one first elongate conveyor chain along said first plane of travel;

f) said trailing lugs and said leading lugs being spaced in alternating series with respect to one another along the length of said leading lug assembly;

g) said leading lug assembly being constructed and arranged to carry said leading lugs along a second plane of travel positioned with respect to said first plane of travel on said housing and extending at least partially along the length of said first plane of travel, and to move said leading lugs toward and into said first plane of travel as said leading lugs are moved in the direction of the path of travel by said second drive assembly.

23. The overhead flight conveyor assembly of claim 22, wherein said second plane of travel is inclined toward said first plane of travel.

24. The overhead flight conveyor assembly of claim 22, wherein said second plane of travel is spaced from and parallel to said first plane of travel, said second plane of travel terminating in a cam profile constructed and arranged to move said leading lug along a predetermined path from said second plane of travel into said first plane of travel.

* * * * *